US008852842B2

(12) United States Patent
Iga et al.

(10) Patent No.: US 8,852,842 B2
(45) Date of Patent: Oct. 7, 2014

(54) PRODUCTION PROCESS OF TONER

(75) Inventors: Takashi Iga, Tokyo (JP); Hisashi Kurokawa, Tokyo (JP)

(73) Assignee: Zeon Corporation, Tokyo (JP)

( * ) Notice: Subject to any disclaimer, the term of this patent is extended or adjusted under 35 U.S.C. 154(b) by 858 days.

(21) Appl. No.: 12/918,380

(22) PCT Filed: Feb. 18, 2009

(86) PCT No.: PCT/JP2009/052740
§ 371 (c)(1),
(2), (4) Date: Aug. 19, 2010

(87) PCT Pub. No.: WO2009/104628
PCT Pub. Date: Aug. 27, 2009

(65) Prior Publication Data

US 2010/0319212 A1 Dec. 23, 2010

(30) Foreign Application Priority Data

Feb. 22, 2008 (JP) ..... 2008-040914
Sep. 30, 2008 (JP) ..... 2008-255512
Sep. 30, 2008 (JP) ..... 2008-255513

(51) Int. Cl.
*G03G 9/087* (2006.01)
*G03G 9/08* (2006.01)

(52) U.S. Cl.
CPC ..... *G03G 9/0804* (2013.01); *G03G 9/0815* (2013.01)
USPC ..... 430/137.21; 430/137.14; 430/137.17; 430/137.19

(58) Field of Classification Search
USPC ..... 430/137.1, 137.19, 137.17, 137.14, 430/137.21
See application file for complete search history.

(56) References Cited

FOREIGN PATENT DOCUMENTS

| | | | |
|---|---|---|---|
| JP | 11-184153 | A | 7/1999 |
| JP | 11-352721 | A | 12/1999 |
| JP | 2001-134016 | A | 5/2001 |
| JP | 2004-163820 | A | 6/2004 |
| JP | 2004-226445 | A | 8/2004 |
| JP | 2004-258589 | A | 9/2004 |
| JP | 2007-004135 | A | 1/2007 |
| JP | 3865022 | B2 | 1/2007 |
| JP | 2007-054729 | A | 3/2007 |

OTHER PUBLICATIONS

AIPN Japanese Patent Office machine-assisted translation of Japanese Patent 2007-004135 (pub. Jan. 2007).*
AIPN Japanese Patent Office machine-assisted translation of Japanese Patent 2007-054729 (pub. Mar. 2007).*
AIPN Japanese Patent Office machine-assisted translation of Japanese Patent 2004-226445 (pub. Aug. 2004).*
AIPN Japanese Patent Office machine-assisted translation of Japanese Patent 2001-134016 (pub. May 2001).*
International Search Report of PCT/JP2009/052740, mailing date of Apr. 14, 2009.

* cited by examiner

*Primary Examiner* — Janis L Dote
(74) *Attorney, Agent, or Firm* — Westerman, Hattori, Daniels & Adrian, LLP

(57) ABSTRACT

A production process of a toner, wherein wet colored resin particles are poured into a rotary vane type agitating device having a structure that an agitating vane fixed to a rotating drive shaft extending through a bottom wall of an agitation vessel is arranged at a bottom of the agitation vessel, and at least one gas inlet port and at least one gas outlet port are arranged at a lower portion of the agitation vessel and an upper portion of the agitation vessel, respectively, the wet colored resin particles are dried by a method, in which the wet colored resin particles are agitated by the rotary vane within the agitation vessel while supplying a heated gas, thereby forming a fluidized bed, and a mixed gas containing water is discharged from the gas outlet port to the outside, and at that time, drying conditions are controlled in such a manner that the temperature of the gas discharged falls within a range from 20 to 60° C.

9 Claims, 3 Drawing Sheets

PRODUCTION PROCESS OF TONER

TECHNICAL FIELD

The present invention relates to a production process of a toner, including a drying step of colored resin particles formed by a wet process, and more particularly to a production process of a toner, including a drying step, by which colored resin particles in a wetted state after water washing can be efficiently dried in a short period of time, no colored resin particle is fusion-bonded to an inner wall of a drying device used in drying, and colored resin particles capable of exhibiting excellent toner properties can be collected.

The present invention also relates to a production process of a toner, including an external additive addition step of mixing the dry colored resin particles with an external additive in the same drying device as that used in the drying step after the drying step.

BACKGROUND ART

In an image forming apparatus of an electrophotographic system (including an electrostatic recording system), such as a copying machine, laser beam printer or facsimile, a developer is used for making an electrostatic latent image formed on a photosensitive member visible. The developer comprises, as a main component, colored resin particles with a colorant, a charge control agent, a parting agent and the like dispersed in a binder resin. The colored resin particles are called a toner or toner particles. A one-component developer with an external additive such as fine silica powder attached to the surfaces of the colored resin particles for improving flowability; or a two-component developer composed of the colored resin particles and a carrier may also be called a toner simply. Thus, when these developers are called toners, that fact is clearly described in this description.

The colored resin particles (toner) are roughly divided into a pulverized toner obtained by a pulverization process and a toner obtained by a wet process. In the pulverization process, colored resin particles (pulverized toner) are obtained by a process, in which a thermoplastic resin is melted and kneaded together with additive components such as a colorant, a charge control agent and a parting agent, and the resultant kneaded product is pulverized and classified. The thermoplastic resin used in the pulverization process is synthesized by polymerizing a polymerizable monomer and is a resin component containing no additive component therein.

In the wet process, colored resin particles (colored polymer particles) are obtained by, for example, a process (hereinafter referred to as "a suspension polymerization process"), in which a polymerizable monomer composition containing a polymerizable monomer and additive components is suspension-polymerized in the presence of a polymerization initiator in an aqueous dispersion medium. The colored polymer particles are called a polymerized toner. In addition to the suspension polymerization process, an emulsion polymerization aggregation process, a dispersion polymerization process and a dissolution suspension process are known as the wet process. For example, in the emulsion polymerization aggregation process, colored resin particles are obtained by a process, in which emulsion particles obtained by emulsion polymerization of a polymerizable monomer and various additive components such as a colorant are aggregated and granulated.

In the production process of toner particles by such a wet process, a drying step is arranged because water is used as a dispersion medium. In the production process of a toner by the wet process, a drying method by a continuous system (continuous process) or batch system (batch process) has heretofore been generally used.

In the drying method by the continuous system, a method making use of a flash dryer or fluidized bed dryer has been proposed. For example, Japanese Patent Application Laid-Open No. 2004-258589 (Patent Literature 1) has proposed a method of continuously drying toner particles with an air current by a loop type dryer in a drying step in a production process of a toner, including a step of washing and dehydrating toner particles formed in an aqueous dispersion medium and then drying the resultant wet toner particles. The mere use of the air current is insufficient in dispersion of the toner particles, and so drying efficiency is low. Patent Literature 1 describes that the toner particles were dried with hot air controlled to 90° C. (see Example 1 and the like). When the drying step is performed by using the hot air controlled to 90° C., the drying efficiency can be improved, but fusion bonding of the toner particles to an inner wall of the drying device cannot be avoided, and moreover the toner properties of the resulting toner tend to be lowered due to thermal fusion bonding among the toner particles and deterioration of the toner particles at the high temperature. When the temperature of the hot air is lowered, toner particles that are not sufficiently dried come to pass through the drying device. In other words, undried toner particles short-pass through the drying device.

Japanese Patent Application Laid-Open No. 11-184153 (Patent Literature 2) discloses a method, in which colored polymer particles in a wetted state are continuously fed into a dryer with an agitating rotor and an inlet port of hot air arranged at lower portions thereof, and dried by forming a fluidized bed with the hot air while agitating the wet colored polymer particles by the agitating rotor. According to this method, the short-pass of the undried wet colored polymer particles can be prevented. According to the drying method disclosed in Patent Literature 2, however, the temperature of the hot air at the inlet port is controlled within a range from 60 to 150° C., preferably from 80 to 120° C. to conduct the drying treatment, so that fusion bonding of the colored polymer particles to an inner wall of the dryer is easy to occur when the dryer is operated for a long period of time, and a tendency to lower toner properties due to deterioration by heat is also shown.

On the other hand, as the drying method by the batch system (batch process), have been proposed a method making use of a conical type or Nautor type dryer and a vacuum-drying method. However, the conventional drying methods of the batch system takes a markedly long time to conduct drying compared with the drying methods of the continuous system and are thus extremely low in productive efficiency.

Therefore, there has been a demand for development of a drying method that prevents the deterioration by heat of colored resin particles (toner particles) and has high productive efficiency.

Patent Literature 1: Japanese Patent Application Laid-Open No. 2004-258589

Patent Literature 2: Japanese Patent Application Laid-Open No. 11-184153

DISCLOSURE OF THE INVENTION

Technical Problem

It is an object of the present invention to provide a production process of a toner, including a drying step of colored resin particles obtained by a wet process, by which the colored resin particles can be dried with high efficiency by a batch system, no colored resin particle is fusion-bonded to an inner wall of a dryer, and colored resin particles excellent in toner properties can be collected.

Another object of the present invention is to provide a production process of a toner, by which fusion bonding of colored resin particles to an inner wall of a dryer is hard to occur even when a drying step of a batch system is conducted continuously and repeatedly, and colored resin particles excellent in toner properties can be collected.

A further object of the present invention is to provide a production process of a toner having excellent properties, by which a drying step and an external additive addition step can be performed continuously and efficiently by the same device.

The present inventors have carried out an extensive investigation with a view toward achieving the above objects. As a result, it has been found that a rotary vane type agitating device having a structure that an agitating vane fixed to a rotating drive shaft extending through a bottom wall of an agitation vessel is arranged at a bottom of the agitation vessel, and at least one gas inlet port and at least one gas outlet port are arranged at a lower portion of the agitation vessel and an upper portion of the agitation vessel, respectively, is used as a drying device in a drying step of wet colored resin particles including colored resin particles formed by a wet process, and drying conditions are controlled, whereby drying can be efficiently conducted, none of the colored resin particle are attached to an inner wall of the device, and a toner high in initial charge level and excellent in printing durability is obtained.

The present inventors have further found that an external additive addition step of attaching an external additive such as fine silica particles to the surfaces of the colored resin particles is performed continuously from the drying step, whereby the complicated external additive addition step can be simplified, and moreover a toner high in initial charge level and hard to cause fogging is obtained.

The drying step and the external additive addition step have heretofore not been performed by means of the same agitating device. Even if the drying step has been performed by means of a specified agitating device, an external additive has been generally attached to the surfaces of the colored resin particles by means of an agitating device equipped with an agitating vane rotating at high speed, such as a Henschel mixer because agitating condition in the external additive addition step are markedly different from that in the drying step. If the drying step and the external additive addition step have been continuously performed by means of the same agitating device, it has been difficult to obtain a toner excellent in toner properties.

The present invention has been led to completion on the basis of these findings.

Solution to Problem

According to the present invention, there is provided a production process of a toner composed of colored resin particles, comprising Step 1 of preparing an aqueous dispersion containing colored resin particles formed by a wet process; Step 2 of washing the colored resin particles with water; Filtration Step 3 of separating the colored resin particles by filtration to obtain wet colored resin particles; and Drying Step 4 of drying the wet colored resin particles, wherein in Drying Step 4, (a) the wet colored resin particles are poured into a rotary vane type agitating device having an agitation vessel, a rotating drive shaft and an agitating vane and having a structure that the agitating vane fixed to the rotating drive shaft extending through a bottom wall of the agitation vessel is arranged at a bottom of the agitation vessel, and at least one gas inlet port and at least one gas outlet port are arranged at a lower portion of the agitation vessel and an upper portion of the agitation vessel, respectively, (b) the wet colored resin particles are dried by a method, in which the wet colored resin particles are agitated by the rotary vane within the agitation vessel while supplying a heated gas from the gas inlet port, thereby forming a fluidized bed of the wet colored resin particles, and a mixed gas containing the heated gas supplied and water volatilized out of the wet colored resin particles is discharged from the gas outlet port to the outside, and (c) at that time, drying conditions are controlled in such a manner that the temperature of the mixed gas discharged from the gas outlet port falls within a range from 20 to 60° C.

The production process of the toner according to the present invention includes, as a preferred embodiment, a process of supplying the heated gas from the gas inlet port in Drying Step 4 by a method, in which a main axis of a gas inlet line communicating with the gas inlet port is set to an angle within a range from 0 to 30° with a tangential direction to an inner peripheral surface of the agitation vessel when the heated gas is supplied from the gas inlet port, and the heated gas is blown into the agitation vessel from the gas inlet port along a direction of the main axis of the gas inlet line.

The production process of the toner according to the present invention includes, as another preferred embodiment, a process further comprising External Additive Addition Step 5 of mixing the dry colored resin particles with an external additive after Drying Step 4, wherein in External Additive Addition Step 5, the dry colored resin particles are mixed with the external additive in the same rotary vane type agitating device as that used in Drying Step 4.

Advantageous Effects of Invention

According to the present invention, wet colored resin particles can be dried with high efficiency by adopting the drying conditions by the specified batch system in a production process of a toner by a wet process such as a suspension polymerization process, no colored resin particle is fusion-bonded to an inner wall of a drying device, and a toner composed of colored resin particles excellent in toner properties such as charge level and printing durability can be obtained.

According to a preferred embodiment of the present invention, an angle for blowing a heated gas from a gas inlet port is controlled, whereby fusion bonding of colored resin particles to an inner wall of a dryer is hard to occur even when a drying step of a batch system is conducted continuously and repeatedly, and colored resin particles excellent in toner properties can be collected. In other words, according to the present invention, there can be provided a production process of a toner, including a drying step excellent in stability for continuous operation.

According to another preferred embodiment of the present invention, there can be provided a production process of a toner, including an external additive addition step, which can be performed by means of the same agitating device subsequently to a drying step and does not require complicated operations such as transfer to another agitating device.

REFERENCE SIGNS LIST

Figure 1:
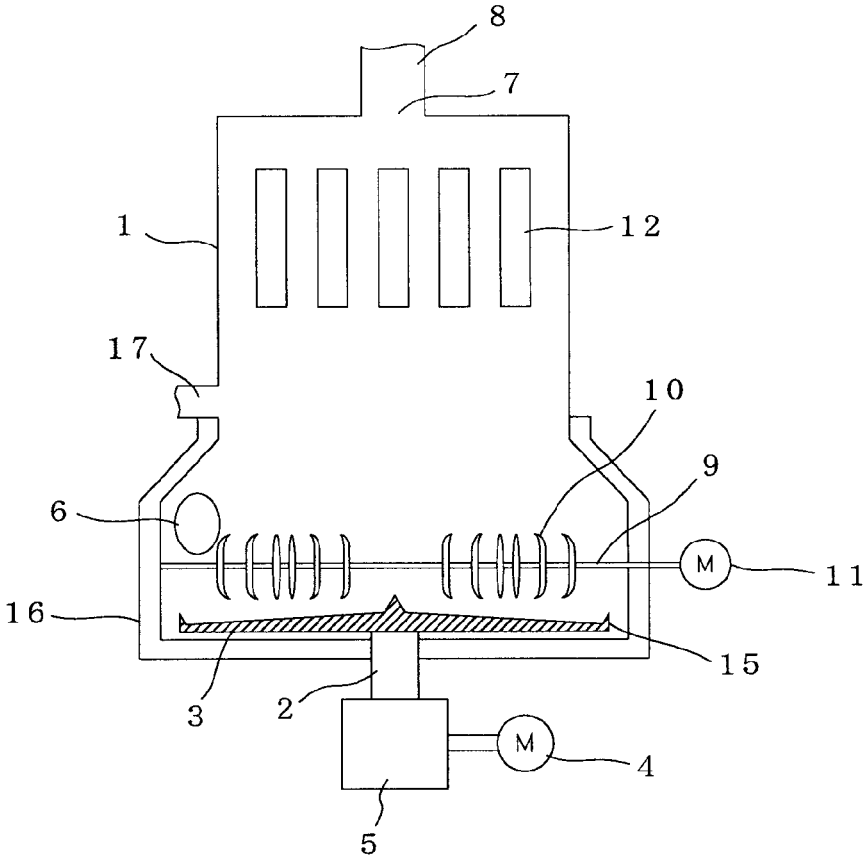
FIG. 1 is a cross-sectional view of a rotary vane type agitating dryer viewed laterally.

1 Agitation vessel
2 Rotating shaft
3 Agitating vane
4 Electric motor for drive
5 Power transmission
6 Inlet port of heated gas
6' Inlet port of heated gas
7 Outlet port of gas
8 Gas outlet line
9 Chopper shaft
10 Chopper blades
11 Electric motor for drive
12 Cyclone or bag filter
13 Heated gas inlet line
13' Heated gas inlet line
13A Line making up a main axis of the gas inlet line
13B Another line along a longitudinal direction of the gas inlet line
14 Rotating direction of the agitating vane
15 Risen portion
16 Jacket
17 Input port for wet colored resin particles
18 Rake face
19 Tangent
20 Heat spot
C Intersection between the main axis of the gas inlet line and the inner peripheral surface of the agitation vessel
α Angle for blowing a heated gas
β Rake angles of vane piece
41 Bottom side of section of vane piece
42 Oblique side (rake face) of section of vane piece
43 Residual side of section of vane piece

BEST MODE FOR CARRYING OUT THE INVENTION

1. Colored Resin Particles by Wet Process

As the production process of colored resin particles in the present invention, is mentioned a wet process such as a suspension polymerization process, emulsion polymerization aggregation process, dispersion polymerization process or dissolution suspension process. By the wet process, a toner excellent in printing properties such as image reproducibility is generally easy to be obtained. In other words, by the wet process such as the suspension polymerization process, emulsion polymerization aggregation process, dispersion polymerization process or dissolution suspension process, colored resin particles having a small particle diameter of micron order and a relatively narrow particle diameter distribution are obtained, and so the use of a developer (toner) comprising the colored resin particles as a functional component in an image forming apparatus of an electrophotographic system permits forming a high-definition and high-quality image.

According to the suspension polymerization process, colored resin particles can be obtained as colored polymer particles by suspension-polymerizing a polymerizable monomer composition containing a polymerizable monomer, a colorant and other additives for toner in an aqueous dispersion medium. According to the emulsion polymerization aggregation process, colored resin particles are produced by emulsion-polymerizing a polymerizable monomer to prepare fine polymer particles (emulsion particles) and aggregating the fine polymer particles together with a colorant and the like. The dissolution suspension process is a process for producing colored resin particles by dissolving or dispersing a binder resin and additive components for toner such as a colorant in an organic solvent, pouring the resultant solution or dispersion into an aqueous medium to form droplets and then removing the organic solvent.

Among these wet processes, the suspension polymerization process is preferred in that the resulting toner is excellent in toner properties. In order to produce colored resin particles (colored polymer particles) by the suspension polymerization process, the following process is generally adopted. A polymerizable monomer and a colorant are mixed to prepare a polymerizable monomer composition. At this time, various kinds of additives such as a charge control agent, a parting agent, a crosslinkable monomer, a macromonomer, a molecular weight modifier, a lubricant and a dispersion aid are mixed as needed. The polymerizable monomer composition is poured into an aqueous dispersion medium containing a dispersion stabilizer, and the resultant mixture is stirred to form droplets of the polymerizable monomer composition. As the aqueous dispersion medium, is generally used water such as ion-exchanged water. However, a hydrophilic solvent such as an alcohol may be added thereto if desired. After the droplets of the polymerizable monomer composition are formed, polymerization is conducted in the presence of a polymerization initiator to form colored polymer particles. If desired, a step of polymerizing a polymerizable monomer for shell in the presence of the colored polymer particles may be added to form colored polymer particles of a core-shell type.

After the polymerization step, the aqueous dispersion containing the colored polymer particles is washed, dehydrated and dried, thereby obtaining dry colored polymer particles. After the dry colored resin particles are classified as needed, they are mixed with an external additive, whereby a one-component developer can be obtained. As the external additive, are used various kinds of fine particles having functions of improving the flowability and abrasiveness of the colored polymer particles. When the colored polymer particles do not contain magnetic powder, a nonmagnetic one-component developer is obtained. When the colored polymer particles contain magnetic powder, a magnetic one-component developer is obtained. When an external additive is added to the colored polymer particles, and a carrier is further added thereto, a nonmagnetic or magnetic two-component developer can be obtained.

(1) Polymerizable Monomer:

The polymerizable monomer is a component for forming a binder resin of the colored polymer particles and is a polymerizable compound. In general, a monovinyl monomer is preferably used as a main component of the polymerizable monomer. Examples of the monovinyl monomer include aromatic vinyl monomers such as styrene, vinyltoluene and α-methylstyrene; unsaturated carboxylic acids such as acrylic acid and methacrylic acid; acrylic acid derivatives such as methyl acrylate, ethyl acrylate, propyl acrylate, butyl acrylate, 2-ethylhexyl acrylate, cyclohexyl acrylate, isobonyl acrylate, dimethylaminoethyl acrylate and acrylamide; methacrylic acid derivatives such as methyl methacrylate, ethyl methacrylate, propyl methacrylate, butyl methacrylate, 2-ethylhexyl methacrylate, cyclohexyl methacrylate, isobonyl methacrylate, dimethylaminoethyl methacrylate and methacrylamide; and monoolefin monomers such as ethylene, propylene and butylene.

The monovinyl monomers may be used either singly or in any combination thereof. Of these monovinyl monomers, a single aromatic vinyl monomer, or a combination of the aromatic vinyl monomer and an acrylic acid derivative and/or a methacrylic acid derivative is preferably used.

(2) Crosslinkable Monomer or Crosslinkable Polymer:

When a crosslinkable monomer or crosslinkable polymer is used together with the monovinyl monomer, the hot offset property of the resulting toner can be improved. The crosslinkable monomer means a monomer having at least two vinyl groups. As specific examples thereof, may be mentioned aromatic divinyl compounds such as divinylbenzene, divinylnaphthalene and derivatives thereof; diethylenically unsaturated carboxylic acid esters such as ethylene glycol dimethacrylate, diethylene glycol dimethacrylate and 1,4-butanediol diacrylate; compounds having two vinyl groups, such as N,N-divinylaniline and divinyl ether; and compounds having three or more vinyl groups, such as pentaerythritol triallyl ether and trimethylolpropane triacrylate.

The crosslinkable polymer is a polymer having two or more vinyl groups in the polymer. As specific examples thereof, may be mentioned esterified products obtained by a condensation reaction of a polymer having two or more hydroxyl groups in its molecule, such as polyethylene, polypropylene, polyester or polyethylene glycol, and an unsaturated carboxylic acid monomer such as acrylic acid or methacrylic acid.

These crosslinkable monomers and crosslinkable polymers may be used either singly or in any combination thereof. The amount of the crosslinkable monomer or polymer used is generally at most 10 parts by weight, preferably 0.01 to 7 parts by weight, more preferably 0.05 to 5 parts by weight, particularly preferably 0.1 to 3 parts by weight per 100 parts by weight of the monovinyl monomer.

(3) Macromonomer:

It is preferable to use a macromonomer together with the monovinyl monomer because the storage stability under high-temperature environment and the fixing ability at low-temperature of the resulting toner can be reconciled. The macromonomer is a macromolecule having a polymerizable carbon-carbon unsaturated double bond at its molecular chain terminal and is an oligomer or polymer having a number average molecular weight of generally 1,000 to 30,000. When the number average molecular weight falls within the above range, the fixing ability and storage stability of the resulting toner can be retained without impairing the melt properties of the macromonomer. Thus, the macromonomer preferably has a number average molecular weight within the above range.

As examples of the polymerizable carbon-carbon unsaturated double bond present at the molecular chain terminal of the macromonomer, may be mentioned an acryloyl group and a methacryloyl group. However, the methacryloyl group is preferred from the viewpoint of easy copolymerization. The macromonomer is preferably that capable of providing a polymer having a glass transition temperature higher than that of a polymer obtained by polymerizing the monovinyl monomer.

As specific examples of the macromonomer, may be mentioned polymers obtained by polymerizing styrene, styrene derivatives, methacrylic esters, acrylic esters, acrylonitrile and methacrylonitrile either singly or in combination of two or more monomers thereof; and macromonomers having a polysiloxane skeleton. Among these, hydrophilic macromonomers are preferred, with polymers obtained by polymerizing a methacrylic ester or acrylic ester by itself or in combination thereof being particularly preferred.

When the macromonomer is used, the used amount thereof is generally 0.01 to 10 parts by weight, preferably 0.03 to 5 parts by weight, more preferably 0.05 to 1 part by weight per 100 parts by weight of the monovinyl monomer. When the amount of the macromonomer used falls within the above range, the fixing ability of the resulting toner is improved while retaining its storage stability. Thus, the macromonomer is preferably used in the amount within the above range.

(4) Colorant:

As the colorant, may be used any of various kinds of pigments and dyes used in the field of toners, such as carbon black and titanium white. As examples of black colorants, may be mentioned carbon black and nigrosine-based dyes and pigments; and magnetic particles such as cobalt, nickel, triiron tetroxide, manganese iron oxide, zinc iron oxide and nickel iron oxide. It is preferable to use carbon black having a primary particle diameter of 20 to 40 nm as the carbon black because the resulting toner can provide images good in image quality, and the safety of the toner in environment is also enhanced. As colorants for color toners, may be used yellow colorants, magenta colorants, cyan colorants, etc.

As the yellow colorants, may be used fused azo compounds, isoindolinone compounds, anthraquinone compounds, azo metallic complexes, methine compounds, allylamide compounds or the like. Specific examples thereof include C.I. Pigment Yellow 3, 12, 13, 14, 15, 17, 62, 65, 73, 74, 83, 90, 93, 95, 96, 97, 109, 110, 111, 120, 128, 129, 138, 147, 155, 168, 180 and 181. Besides the above, Naphthol Yellow S, Hansa Yellow G and C.I. Vat Yellow are mentioned as yellow colorants.

Examples of the magenta colorants include fused azo compounds, diketopyrrolopyrrole compounds, anthraquinone compounds, quinacridone compounds, basic dye lake compounds, naphthol compounds, benzimidazolone compounds, thioindigo compounds and perillene compounds. Specific examples thereof include C.I. Pigment Red 2, 3, 5, 6, 7, 23, 48, 48:2, 48:3, 48:4, 57, 57:1, 58, 60, 63, 64, 68, 81, 81:1, 83, 87, 88, 89, 90, 112, 114, 122, 123, 144, 146, 149, 163, 166, 169, 170, 177, 184, 185, 187, 202, 206, 207, 209, 220, 251 and 254. Besides the above, for example, C.I. Pigment Violet 19 is mentioned as a magenta colorant.

Examples of the cyan colorants include copper phthalocyanine compounds and derivatives thereof, anthraquinone compounds, and basic dye lake compounds. Specific examples thereof include C.I. Pigment Blue 1, 2, 3, 6, 7, 15, 15:1, 15:2, 15:3, 15:4, 16, 17, 60, 62 and 66. Besides the above, for example, Phthalocyanine Blue, C.I. Vat Blue and C.I. Acid Blue are mentioned as cyan colorants.

These colorants may be used either singly or in combination of two or more colorants thereof. The colorant is used in a proportion of generally 0.1 to 50 parts by weight, preferably 1 to 20 parts by weight per 100 parts by weight of the polymerizable monomer.

(5) Pigment Dispersant, Lubricant, Dispersion Aid:

In order to improve the dispersed state of the colorant in the colored polymer particles, it is preferable to treat the surface of the colorant with a pigment dispersant. As the pigment dispersant, is preferred a coupling agent such as an aluminum coupling agent, silane coupling agent or titanium coupling agent. The colorant is used in a proportion of generally 0.1 to 50 parts by weight, preferably 1 to 20 parts by weight per 100 parts by weight of the binder resin or the polymerizable monomer forming the binder resin.

(6) Molecular Weight Modifier:

A molecular weight modifier is preferably used upon the polymerization. As examples of the molecular weight modifier, may be mentioned mercaptans such as t-dodecylmercaptan, n-dodecylmercaptan, n-octylmercaptan, tetraethylthiuram disulfide and 2,2,4,6,6-pentamethylheptane-4-thiol; and halogenated hydrocarbons such as carbon tetrachloride and carbon tetrabromide. The molecular weight modifier is generally contained in the polymerizable monomer composition prior to the initiation of the polymerization. However, it may also be added in the middle of the polymerization. The molecular weight modifier is used in a proportion of generally 0.01 to 10 parts by weight, preferably 0.1 to 5 parts by weight per 100 parts by weight of the polymerizable monomer. If the amount of the molecular weight modifier is too small, the effect of molecular weight modification is not achieved. If the amount is too great, the amount of the remaining monomer is increased.

(7) Charge Control Agent:

In order to improve the charge properties of the resulting toner, various kinds of charge control agents having positively charging ability or negatively charging ability are preferably contained in the polymerizable monomer composition. Example of the charge control agent having positively charging ability include nigrosine dyes, quaternary ammonium salts, triaminotriphenylmethane compounds, imidazole compounds, polyamine resins, and quaternary ammonium (salt) group-containing copolymers.

Example of the charge control agent having negatively charging ability include azo dyes containing a metal such as Cr, Co, Al or Fe, salicylic acid metal compounds, alkylsalicylic acid metal compounds, sulfonic (salt) group-containing copolymers and carboxylic (salt) group-containing copolymers.

As specific examples of charge control agents including commercially available products, may be mentioned charge control agents such as BONTRON N-01 (product of Orient Chemical Industries Ltd., trademark), NIGROSINE BASE EX (product of Orient Chemical Industries Ltd., trademark), SPILON BLACK TRH (product of Hodogaya Chemical Co., Ltd., trademark), T-77 (product of Hodogaya Chemical Co., Ltd.), BONTRON S-34 (product of Orient Chemical Industries Ltd., trademark), BONTRON E-81 (product of Orient Chemical Industries Ltd., trademark), BONTRON E-84 (product of Orient Chemical Industries Ltd., trademark), BONTRON E-89 (product of Orient Chemical Industries Ltd., trademark), BONTRON F-21 (product of Orient Chemical Industries Ltd., trademark), COPY CHARGE NX VP434 (product of Clariant Co., trademark), COPY CHARGE NEG VP2036 (product of Clariant Co., trademark), TNS-4-1 (product of Hodogaya Chemical Co., Ltd.), TNS-4-2 (product of Hodogaya Chemical Co., Ltd.), LR-147 (product of The Japan Carlit Co., Ltd.) and COPY BLUE PR (product of Clariant Co., trademark); and charge control resins such as quaternary ammonium (salt) group-containing copolymers and sulfonic (salt) group-containing copolymers. The charge control agent is used in a proportion of generally 0.01 to 10 parts by weight, preferably 0.1 to 10 parts by weight per 100 parts by weight of the polymerizable monomer.

(8) Parting Agent:

In order to, for example, prevent offset and improve the parting ability of the resulting toner upon fixing by a heated roll, a parting agent may be contained in the polymerizable monomer composition. Examples of the parting agent include polyolefin waxes such as low-molecular weight polyethylene, low-molecular weight polypropylene and low-molecular weight polybutylene; vegetable natural waxes such as candelilla wax, carnauba wax, rice wax, Japan wax and jojoba wax; petroleum waxes such as paraffin wax, microcrystalline wax and petrolatum, and modified waxes thereof; synthetic waxes such as Fischer-Tropsch wax; and esterified products (polyfunctional ester compounds) of polyhydric alcohols.

As the esterified products of the polyhydric alcohols, are preferred fatty acid ester compounds of the polyhydric alcohols. Specific examples thereof include pentaerythritol esters such as pentaerythritol tetramyristate, pentaerythritol tetrapalmitate, pentaerythritol tetrastearate and pentaerythritol tetralaurate; dipentaerythritol esters such as dipentaerythritol hexamyristate, dipentaerythritol hexapalmitate and dipentaerythritol hexylaurate; and fatty acid ester compounds of polyglycerol.

These parting agents may be used either singly or in combination of two or more compounds thereof. The proportion of the parting agent used is generally 0.1 to 50 parts by weight, preferably 0.5 to 20 parts by weight, more preferably 1 to 10 parts by weight per 100 parts by weight of the polymerizable monomer.

(9) Polymerization Initiator:

As the polymerization initiator, is preferably used a radical polymerization initiator. Specific examples thereof include persulfates such as potassium persulfate and ammonium persulfate; azo compounds such as 4,4'-azobis(4-cyanovaleric acid), 2,2'-azobis(2-amidinopropane)dihydrochloride, 2,2'-azobis-2-methyl-N-1,1-bis(hydroxyethyl)-2-hydroxyethylpropionamide, 2,2'-azobis(2,4-dimethylvaleronitrile), 2,2'-azobisisobutyronitrile and 1,1'-azobis(1-cyclohexanecarbonitrile); diacyl peroxides such as isobutyryl peroxide, 2,4-dichlorobenzoyl peroxide and 3,5,5'-trimethylhexanoyl peroxide; peroxy dicarbonates such as bis(4-t-butylcyclohexyl)peroxy dicarbonate, di-n-propylperoxy dicarbonate, diisopropylperoxy dicarbonate, di-2-ethoxyethylperoxy dicarbonate, di(2-ethylethylperoxy)dicarbonate, dimethoxybutylperoxy dicarbonate and di(3-methyl-3-methoxybutylperoxy)dicarbonate; and other peroxides such as (α,α-bis-neodecanoylperoxy)-diisopropylbenzene, cumylperoxy neodecanoate, 1,1',3,3'-tetramethylbutylperoxy neodecanoate, 1-cyclohexyl-1-methylethylperoxy neodecanoate, t-hexylperoxy neodecanoate, t-butylperoxy neodecanoate, t-hexylperoxy pivalate, t-butylperoxy pivalate, methyl ethyl peroxide, di-t-butyl peroxide, acetyl peroxide, dicumyl peroxide, lauroyl peroxide, benzoyl peroxide, t-butylperoxy-2-ethyl hexanoate, diisopropylperoxy dicarbonate, di-t-butylperoxy isophthalate and t-butylperoxy isobutyrate. Redox initiators composed of combinations of these polymerization initiators with a reducing agent may also be used.

Among these polymerization initiators, oil-soluble polymerization initiators soluble in the polymerizable monomer are preferred, and a water-soluble polymerization initiator may also be used in combination with the oil-soluble initiator as needed. The proportion of the polymerization initiator used is generally 0.1 to 20 parts by weight, preferably 0.3 to 15 parts by weight, more preferably 0.5 to 10 parts by weight per 100 parts by weight of the polymerizable monomer. If this proportion used is too low, the rate of polymerization becomes slow. If the proportion is too high, the molecular weight of the resulting polymer becomes low. It is hence not preferred to use the polymerization initiator in such a too low or high proportion. Although the polymerization initiator may be added into the polymerizable monomer composition in advance, it may also be added into the suspension after completion of the step of forming droplets of the polymerizable monomer composition in the aqueous dispersion medium for the purpose of avoiding premature polymerization.

(10) Dispersion Stabilizer:

As a medium for suspension polymerization, is generally used an aqueous dispersion medium containing a dispersion stabilizer. As the dispersion stabilizer, is preferred colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly water-soluble metal hydroxides are preferred because the particle diameter distribution of the resulting colored polymer particles can be narrowed to improve the brightness of an image to be formed.

The colloid of the hardly water-soluble metallic compound is not limited by the production process thereof. However, colloid of a hardly water-soluble metal hydroxide obtained by adjusting the pH of an aqueous solution of a water-soluble polyvalent metallic compound to 7 or higher is preferably used, and colloid of a hardly water-soluble metal hydroxide formed by reacting a water-soluble polyvalent metallic compound with an alkali metal hydroxide salt in an aqueous phase is particularly preferably used. The colloid of the hardly water-soluble metallic compound preferably has number particle diameter distributions, $D_{50}$ (50% cumulative value of number particle diameter distribution) of at most 0.5 μm and $D_{90}$ (90% cumulative value of number particle diameter distribution) of at most 1 μm.

The dispersion stabilizer is used in a proportion of generally 0.1 to 20 parts by weight per 100 parts by weight of the polymerizable monomer. If this proportion is too low, it is difficult to achieve sufficient polymerization stability, so that polymer aggregates are liable to be formed. If this proportion is too high to the contrary, the viscosity of an aqueous solution becomes too high, and the polymerization stability is lowered.

A water-soluble polymer may also be used as the dispersion stabilizer. As examples of the water-soluble polymer, may be mentioned polyvinyl alcohol, methyl cellulose and gelatin. In the present invention, there is no need to use a surfactant. However, the surfactant may be used within limits not increasing the dependency of charging property of the resulting toner on environment for stably conducting the suspension polymerization.

2. Step of Preparing Aqueous Dispersion Containing Colored Resin Particles

The colored resin particles (colored polymer particles) by the suspension polymerization process can be generally obtained through the following respective steps. A polymerizable monomer, a colorant and other additives are mixed by means of a mixer, and the resultant mixture is subjected to wet grinding by means of a media type wet grinding machine (for example, a bead mill), as needed, to prepare a polymerizable monomer composition.

The polymerizable monomer composition is dispersed and agitated in an aqueous dispersion medium containing a dispersion stabilizer to form uniform droplets (primary droplets having a volume average droplet diameter of about 50 to 1,000 μm) of the polymerizable monomer composition. In order to avoid premature polymerization, it is preferable to add a polymerization initiator to the aqueous dispersion medium after the size of the droplets in the aqueous dispersion medium becomes uniform. The polymerization initiator is added and mixed with a suspension in which the droplets of the polymerizable monomer composition have been dispersed in the aqueous dispersion medium, and the resultant mixture is further agitated by means of a high-speed rotation shearing type agitator until the droplet diameter of the droplets becomes a fine droplet diameter near to that of the intended toner particles. In this manner, a suspension containing the droplets (typically, secondary droplets having a volume average droplet diameter of about 1 to 12 μm) having a fine droplet diameter is prepared.

This suspension is charged into a polymerization reactor to conduct suspension polymerization at a temperature of generally 5 to 120° C., preferably 35 to 95° C. If the polymerization temperature is too low, it is difficult to control the polymerization reaction because a polymerization initiator high in catalytic activity must be used. If the polymerization temperature is too high, and an additive melted at a low temperature is contained, this additive may bleed on the surface of the resulting toner to deteriorate the storage stability of the toner.

The volume average droplet diameter and droplet diameter distribution of the fine droplets of the polymerizable monomer composition affect the volume average particle diameter and particle diameter distribution of the resulting toner. If the droplet diameter of the droplets is too great, the particle diameter of the toner particles to be formed becomes too great to lower the resolution of an image to be formed. If the droplet diameter distribution of the droplets is too wide, the fixing temperature of the resulting toner varies to cause inconveniences such as occurrence of fogging or toner filming. Accordingly, the droplets of the polymerizable monomer composition are desirably formed so as to have almost the same size as that of the toner particles to be formed.

The volume average droplet diameter of the droplets of the polymerizable monomer composition is generally 1 to 12 μm, preferably 3 to 10 μm, more preferably 4 to 9 μm. When it is intended to provide a toner having a particularly small particle diameter for providing a high-definition image, it is desirable to make the volume average droplet diameter of the droplets small. The droplet diameter distribution (volume average droplet diameter/number average droplet diameter) of the droplets of the polymerizable monomer composition is generally 1 to 3, preferably 1 to 2.5, more preferably 1 to 2. When particularly fine droplets are formed, it is preferable to adopt a method, in which an aqueous dispersion medium containing the polymerizable monomer composition is passed through between a rotor rotated on its axis at a high speed and a stator surrounding it and having small openings or comb-like teeth.

As the polymerizable monomer, at least one is selected from among the above-mentioned monovinyl monomers. In order to lower a fixing temperature of the resulting toner, a polymerizable monomer or a combination of polymerizable monomers, which permits forming a polymer having a glass transition temperature (Tg) of the order of generally 80° C. or lower, preferably 40 to 80° C., more preferably 50 to 70° C., is preferably selected. When the polymer forming the binder resin is a copolymer in the present invention, the Tg thereof is a calculated value (referred to as "calculated Tg") calculated out according to the kinds and proportions of the polymerizable monomers used.

Colored polymer particles with the additive components such as the colorant dispersed in the polymer of the polymerizable monomer are formed by the suspension polymerization. In the present invention, the colored polymer particles may be used as a toner. In order to improve the storage stability (blocking resistance), low-temperature fixing ability and melting ability upon fixing of the resulting toner, however, an additional polymer layer may be formed on the colored polymer particles obtained by the suspension polymerization to provide a capsule toner having a core-shell type structure.

As a process for forming the core-shell type structure, may be adopted a process in which the colored polymer particles are used as core particles, and a polymerizable monomer for shell is additionally polymerized in the presence of the core particles to form a polymer layer (shell) on each surface of the core particles. When a monomer forming a polymer having a Tg higher than the Tg of the polymer component forming the core particles is used as the polymerizable monomer for shell, the storage stability of the resulting toner can be improved. On the other hand, the Tg of the polymer component forming the core particles is set low, thereby permitting lowering the fixing temperature of the resulting toner and improving the melting properties. Accordingly, the core-shell type colored polymer particles are formed in the polymerization step, thereby providing a toner capable of coping with speeding-up of printing (copying, printing, etc.), formation of full-color images and permeability through OHP (overhead projector).

As polymerizable monomers for forming the core and shell, respective preferable monomers may be suitably selected from among the above-mentioned monovinyl monomers. A weight ratio of the polymerizable monomer for core to the polymerizable monomer for shell is generally 40/60 to 99.9/0.1, preferably 60/40 to 99.7/0.3, more preferably 80/20 to 99.5/0.5. If the proportion of the polymerizable monomer for shell is too low, the effect of improving the storage stability of the resulting toner becomes little. If the proportion is too high, the effect of lowering the fixing temperature of the resulting toner becomes little.

The Tg of the polymer formed from the polymerizable monomer for shell is generally higher than 50° C., but not higher than 120° C., preferably higher than 60° C., but not higher than 110° C., more preferably higher than 80° C., but not higher than 105° C. A difference in Tg between the polymer formed from the polymerizable monomer for core and the polymer formed from the polymerizable monomer for shell is preferably at least 10° C., more preferably at least 20° C., particularly preferably at least 30° C. In many cases, a monomer capable of forming a polymer having a Tg of generally at most 60° C., preferably 40 to 60° C. is preferably selected as the polymerizable monomer for core from the viewpoint of a balance between fixing temperature and storage stability. On the other hand, as the polymerizable monomer for shell, monomers capable of forming a polymer having a Tg higher than 80° C., such as styrene and methyl methacrylate, may be preferably used either singly or in combination of two or more monomers thereof.

The polymerizable monomer for shell is preferably added to the polymerization reaction system as droplets having a droplet diameter smaller than the average particle diameter of the core particles. If the droplet diameter of the droplets of the polymerizable monomer for shell is too great, it is difficult to uniformly form a polymer layer around the core particles. In order to form the polymerizable monomer for shell into fine droplets, it is only necessary to subject a mixture of the polymerizable monomer for shell and an aqueous dispersion medium to a finely dispersing treatment by means of, for example, an ultrasonic emulsifier and add the resultant dispersion to the polymerization reaction system.

When the polymerizable monomer for shell is a relatively water-soluble monomer (for example, methyl methacrylate) having a solubility of at least 0.1% by weight in water at 20° C., the monomer tends to relatively quickly migrate into the surfaces of the core particles, so that there is no need to conduct the finely dispersing treatment. However, it is preferable to conduct the finely dispersing treatment from the viewpoint of forming a uniform shell. When the polymerizable monomer for shell is a monomer (for example, styrene) having a solubility lower than 0.1% by weight in water at 20° C., it is preferable that the monomer be made easy to migrate into the surfaces of the core particles by conducting the finely dispersing treatment or adding an organic solvent (for example, an alcohol) having a solubility of at least 5% by weight in water at 20° C. to the reaction system.

A charge control agent may be added to the polymerizable monomer for shell. As the charge control agent, is preferred the same charge control agent as that used in the production of the core particles. When the charge control agent is used, it is used in a proportion of generally 0.01 to 10 parts by weight, preferably 0.1 to 5 parts by weight per 100 parts by weight of the polymerizable monomer for shell.

In order to produce the toner of the core-shell structure, the polymerizable monomer for shell or an aqueous dispersion thereof is added to the suspension containing the core particles in one lot, or continuously or intermittently. It is preferable from the viewpoint of efficient formation of the shell to add a water-soluble radical initiator at the time the polymerizable monomer for shell is added. It is considered that when the water-soluble polymerization initiator is added at the time the polymerizable monomer for shell is added, the water-soluble polymerization initiator enters in the vicinity of each outer surface of the core particles into which the polymerizable monomer for shell has migrated, so that the polymer layer is easy to be formed on each surface of the core particles.

As examples of the water-soluble polymerization initiator, may be mentioned persulfates such as potassium persulfate and ammonium persulfate; and azo initiators such as 2,2'-azobis[2-methyl-N-(2-hydroxyethyl)propionamide] and 2,2'-azobis-[2-methyl-N-[1,1-bis(hydroxymethyl)ethyl]propionamide. The amount of the water-soluble polymerization initiator used is generally 0.1 to 50% by weight, preferably 1 to 20% by weight per 100 parts by weight of the polymerizable monomer for shell.

The average thickness of the shell is generally 0.001 to 1.0 μm, preferably 0.003 to 0.5 μm, more preferably 0.005 to 0.2 μm. If the thickness of the shell is too large, the fixing ability of the resulting toner is deteriorated. If the thickness is too small, the storage stability of the resulting toner is deteriorated. The particle diameters of the core particles and the thickness of the shell in the toner can be determined by directly measuring the size and shell thickness of each of particles selected at random from electron photomicrographs thereof when they can be observed through an electron microscope. If the core and shell in each particle are difficult to be observed through the electron microscope, the thickness of the shell can be calculated out from the particle diameter of the core particle and the amount of the polymerizable monomer used for forming the shell.

3. Washing Step

An aqueous dispersion medium containing the colored polymer particles (core-shell type colored polymer particles) is obtained by the step of obtaining the aqueous dispersion of the colored polymer particles. This aqueous dispersion medium may be provided as a dispersion containing the colored polymer particles as it is, or by adding ion-exchanged water or the like for adjusting the concentration of the colored polymer particles. It is desirable that this dispersion is then subjected to a stripping treatment, as needed, to remove volatile organic components including unreacted polymerizable monomer(s), which remain in the colored polymer particles.

An acid treatment or alkali treatment is conducted according to the kind of the dispersion stabilizer used without conducting the stripping treatment or after the stripping treatment is conducted, thereby solubilizing the dispersion stabilizer in water and removing it.

When the stripping treatment is conducted, the treatment is preferably conducted after completion of the polymerization reaction for reducing the amount of the unreacted polymerizable monomer(s) to the utmost. If desired, the stripping treatment may be conducted in the latter half of the polymerization reaction and at a stage that a conversion into a polymer is preferably at least 90%, more preferably at least 95% while continuing the polymerization reaction.

Upon the stripping treatment, a defoaming agent may be added to the dispersion for inhibiting excessive bubbling. Upon the stripping treatment, bubbling occurs on the liquid level of the dispersion containing the colored polymer particles to form bubbles. When the bubbles excessively increase and overflow an evaporator, a gas circulation line connected to the top of the evaporator is contaminated, or piping is clogged, so that frequent cleaning is required.

As a stripping treatment method for the dispersion containing the colored polymer particles, are used a method of blowing an inert gas (nitrogen, argon, helium or the like) and a method of blowing saturated steam in combination. A method of conducting stripping under reduced pressure while blowing these gasses into the dispersion may also be adopted. Upon the stripping treatment, the dispersion is heated, whereby volatilization of volatile organic components including the remaining monomer(s) can be helped to increase the recovery efficiency of the remaining monomer(s).

After completion of the stripping treatment step, a separation purification treatment comprising, for example, acid washing or alkali washing, filtration and dehydration, washing with ion-exchanged water, and filtration and dehydration is conducted. When colloid of a hardly water-soluble metal hydroxide is used as the dispersion stabilizer, acid washing is conducted to solubilize the colloid in water and remove it.

The acid washing is desirably conducted after the dispersion is cooled to about 25° C. by, for example, circulating cooling water through a jacket after the stripping step has been conducted if desired. The acid washing is conducted by adding preferably sulfuric acid to the dispersion containing the colored polymer particles to neutralize the dispersion to about pH 4.5. The dispersion containing the colored polymer particles after the neutralization is filtered and dehydrated. Thereafter, ion-exchanged water is newly added to the colored polymer particles filtered and dehydrated to slurry the colored polymer particles again (reslurrying step), and the slurry is filtered and dehydrated again. This filtration and dehydration, and the reslurrying step are conducted several times repeatedly, thereby collecting a wet cake of colored polymer particles in a wetted state. The filtration and dehydration, and the reslurrying step may be conducted about 5 times repeatedly. The water washing step may also be continuously conducted by a method of using a belt conveyor, on which a filter cloth has been arranged, and spraying water on the wet cake.

4. Filtration Step

After the water washing step, the colored polymer particles are separated by filtration to obtain wet colored resin particles. The separation by filtration is as described above. The wet colored resin particles are generally a wet cake in a wetted state having a water quantity (water content) of the order of 10 to 50% by weight. A wet cake to be fed to a rotary vane type agitating dryer used in a drying step is desirably wet colored resin particles having a water quantity within a range preferably at most 50% by weight, more preferably at most 30% by weight, particularly preferably at most 25% by weight from the viewpoints of flowability and drying efficiency. The water quantity means a water contend by weight, more specifically, a percentage of the weight of water to the whole weight (weight of the wet cake).

5. Drying Step

The production process of the toner according to the present invention comprises Step 1 of preparing an aqueous dispersion containing colored resin particles formed by a wet process; Step 2 of washing the colored resin particles with water; Filtration Step 3 of separating the colored resin particles by filtration to obtain wet colored resin particles; and Drying Step 4 of drying the wet colored resin particles.

In Drying Step 4, a device having an agitation vessel, a rotating drive shaft and an agitating vane is used. More specifically, a rotary vane type agitating device having a structure that the agitating vane fixed to the rotating drive shaft extending through a bottom wall of the agitation vessel is arranged at a bottom of the agitation vessel, and at least one gas inlet port and at least one gas outlet port are arranged at a lower portion of the agitation vessel and an upper portion of the agitation vessel, respectively, is used.

FIG. 1 illustrates a schematic cross-sectional view of an exemplary rotary vane type agitating device used in the present invention. This rotary vane type agitating device has a structure that an agitating vane 3 fixed to a rotating drive shaft 2 extending through a bottom wall of an agitation vessel 1 is arranged at a bottom of the agitation vessel 1, and at least one gas inlet port 6 and at least one gas outlet port 7 are arranged at a lower portion of the agitation vessel 1 and an upper portion of the agitation vessel 1, respectively.

The rotating drive shaft 2 is connected to an electric motor for drive 4 through a power transmission 5. The agitating vane 3 is fixed to the rotating drive shaft 2 arranged vertically and rotates around the rotating drive shaft 2 at the bottom of the agitation vessel 1.

Figure 2:
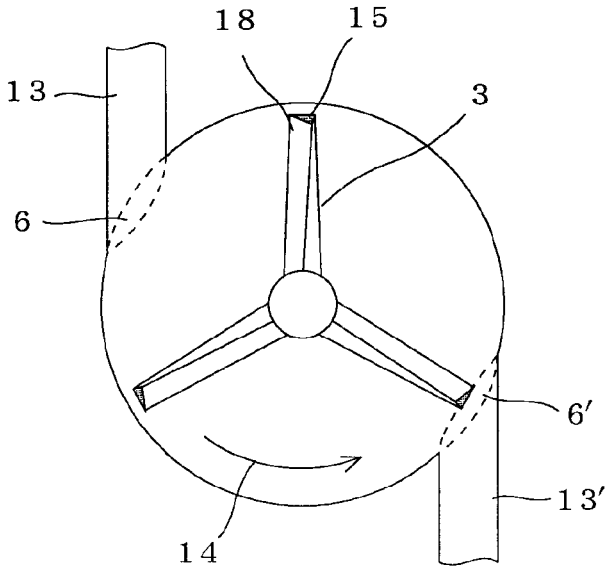
FIG. 2 is a cross-sectional view of the rotary vane type agitating dryer viewed from the top.

The agitating vane 3 is composed of, for example, 3 vane pieces each extending linearly from the center of the rotating drive shaft 2 toward a centrifugal direction as illustrated in the cross-sectional view of FIG. 2. A risen portion 15 curved upward is formed at the distal end of each vane piece. The risen portion 15 may not be formed so far as dispersion or mixing of the colored resin particles is efficiently conducted.

A rake face 18 for raking up the wet colored resin particles within the agitation vessel 1 is formed on an oblique side in a progressing direction of each vane piece. The section of each vane piece forms a triangle having a long bottom side. An angle formed by the oblique side (rake face) in a rotating direction of the vane piece with the bottom (bottom side) of the vane piece is referred to as a rake angle. The rake angle of this rake face 18 is preferably formed so as to become continuously small toward the distal end from the proximal end. For example, when the rake angle of the rake face 18 of each vane piece is set within a range generally from 30 to 50°, preferably from 40 to 50° (typically, 45°) at the proximal end portion on the side of the rotating drive shaft 2, and within a range generally from 15 to 35°, preferably from 20 to 30° (typically, 25°) at the distal end portion near to the inner wall of the agitation vessel so as to become continuously small toward the distal end from the proximal end, a difference in raking effect by a peripheral speed difference between the proximal end portion and the distal end portion can be made little, whereby the dispersion or mixing of the colored resin particles can be efficiently conducted.

Figure 4:
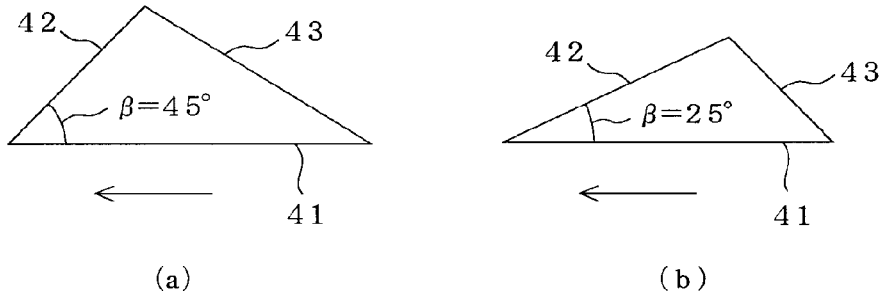
FIG. 4 illustrates a rake angle β of each vane piece making up an agitating vane.

The rake angle is specifically described with reference to FIG. 4. The section of each vane piece of the agitating vane forms a triangle having a long bottom side 41 as illustrated in FIGS. 4(*a*) and 4(*b*). An arrow indicates a rotating direction, i.e., a progressing direction of the vane piece. A side 42 of the triangle indicates a section of the rake face 18, and a side 43 indicates a residual side of the triangle. An angle β formed by the bottom side 41 and the side 42 indicating the rake face 18 is defined as a rake angle. FIG. 4(*a*) illustrates a section of the vane piece at the proximal end portion where the rake angle β is 45°, and FIG. 4(*b*) illustrates a section of the vane piece at the distal end portion where the rake angle β is 25°.

The agitation vessel 1 is constructed by forming an upper half portion and a lower half portion of a peripheral wall of the vessel into respective cylinders and joining both peripheral walls by a tapered peripheral wall which becomes narrow upward. An input port 17 for wet colored resin particles (wet cake) is provided in a lower end of the upper half peripheral wall portion, and an openable and closeable lid member is arranged at the input port 17.

The agitation vessel 1 is preferably provided with a jacket 16 outside the agitation vessel 1 at least from the bottom to a side including a portion where the agitating vane 3 is arranged. FIG. 1 illustrates the agitating device that the jacket 16 is provided from the bottom of the agitation vessel 1 to the side including the portion where the agitating vane 3 is arranged. However, the jacket may also be arranged around the upper half peripheral wall of the agitation vessel. The jacket 16 can contribute to temperature control within the agitation vessel by circulating a heated fluid such as hot water between the jacket 16 and the outer peripheral wall of the agitation vessel 1. In short, in the drying step, the interior of the agitation vessel can be heated or thermally insulated by circulating the heated fluid through the jacket 16.

As apparent from the cross-sectional view illustrated in FIG. 2, the rotary vane type agitating device is such that 2 gas inlet ports 6 and 6' are arranged in opposition to each other at lower portions of the agitation vessel 1. However, the number of the gas inlet ports may be one or plural. In the drying step, while the agitating vane rotates, a heated gas is supplied in a tangential direction to the inner peripheral surface (peripheral wall surface) of the agitation vessel 1 circular in section from the 2 gas inlet ports 6 and 6' through respective gas inlet lines 13 and 13', whereby a fluidized bed of the wet colored resin particles can be efficiently formed.

The gas inlet ports 6 and 6' for introducing the heated gas are opened on the side upper than the position of the agitating vane 3 and at upper portions of the lower half peripheral wall portion of the agitation vessel 1. When the gas inlet ports 6 and 6' are formed in such a manner that a main axis 13A of each of the gas inlet lines 13 and 13' respectively communicating with the gas inlet ports is positioned in a tangential direction to an inner peripheral surface (inner wall surface) of the agitation vessel 1 (a portion where agitation is conducted), a swirl flow of the wet colored resin particles is easy to be formed within the agitation vessel. In other words, when the heated gas is supplied in the tangential direction to the inner peripheral surface of the agitation vessel 1, the heated gas is easy to form a swirl flow in the interior of the agitation vessel 1. Air passages are formed in the agitating vane 3 and the agitation shaft 2 as auxiliary inlet routes for the heated gas, whereby the heated gas introduced from the agitation shaft 2 may also be introduced into the agitation vessel 1 from a large number of exhaust nozzles provided in the agitating vane 3.

On the other hand, when the main axis of each of the gas inlet lines 13 and 13' respectively communicating with the gas inlet ports is set in a tangential direction to the inner peripheral surface of the agitation vessel 1, fusion bonding of the colored resin particles may occur at a particular portion of the inner wall of the dryer when the drying step of the batch system is conducted continuously and repeatedly.

Thus, the heated gas is preferably supplied from the gas inlet ports by a method, in which the main axis of each of the gas inlet lines 13 and 13' respectively communicating with the gas inlet ports 6 and 6' is set to an angle (hereinafter referred to as "a blowing angle") within a range from 0 to 30° with the tangential direction to the inner peripheral surface of the agitation vessel 1, and the heated gas is blown into the agitation vessel from the gas inlet ports 6 and 6' along the main axis directions of the gas inlet lines 13 and 13'.

Figure 5:
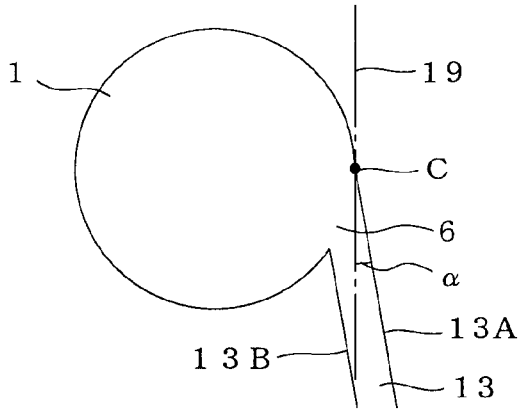
FIG. 5 illustrates a blowing angle α.

The blowing angle is described with reference to FIG. 5. FIG. 5 illustrates, as an example, a case of one gas inlet port 6 (also, a case of one gas inlet line 13 communicating with the port) for the sake of brief description. The same applies to a case where two or more gas inlet ports are arranged. When a plurality of gas inlet ports is arranged, respective blowing angles may be the same or different from each other. However, the angles are preferably the same.

As illustrated in the cross-sectional view of FIG. 5, the gas inlet port 6 is provided in the agitation vessel 1 circular in section. The gas inlet line 13 is arranged in communication with the gas inlet port. The gas inlet port and gas inlet line have diameters of respective predetermined sizes. In order to make description simple and precisely define the blowing angle, a line 13A of two lines 13A and 13B along a longitudinal direction of an inner peripheral surface of the gas inlet line in the cross-sectional view illustrated in FIG. 5 is defined as a main axis of the gas inlet line. The line 13A forms an angle wider than the line 13B with an outer wall of the agitation vessel 1.

A point where the main axis 13A of the gas inlet line intersects an inner peripheral surface of the agitation vessel 1 at an opening of the gas inlet port 6 is defined as an intersection C. A tangent 19 passing through the intersection C is drawn to the inner peripheral surface of the agitation vessel 1 circular in section. An angle α formed by the tangent 19 with the main axis 13A of the gas inlet line 13 is defined as a blowing angle.

When the blowing angle α is 0°, the main axis 13A of the gas inlet line 13 communicating with the gas inlet port 6 is arranged in the tangential direction to the inner peripheral surface of the agitation vessel 1. When the blowing angle α is 0°, a swirl flow is easy to be formed within the agitation vessel 1 by a heated gas blown from the gas inlet port 6 through the gas inlet line 13, and so the efficiency for drying the wet colored resin particles is increased. Therefore, the blowing angle α is preferably set to 0° from the viewpoint of swirl flow.

Figure 6:
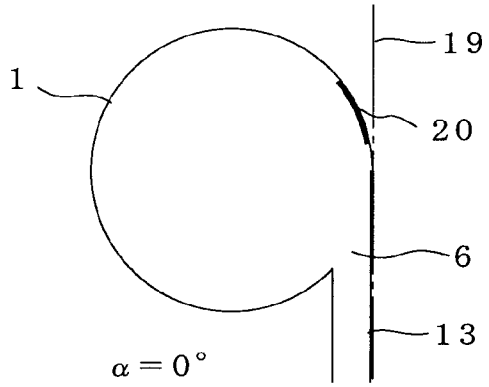
FIG. 6 illustrates a case where the blowing angle α is 0°.

On the other hand, when the drying by the batch system is conducted repeatedly by means of the same dryer, fusion bonding of the colored resin particles to the inner wall of the agitation vessel 1 may occur in some cases before or after the number of batches exceeds 10 times. Specifically, when the heated gas is blown in the tangential direction to the inner peripheral surface of the agitation vessel with the blowing angle set to 0° as illustrated in FIG. 6, a heat spot 20 is easy to be generated when continuous operation is conducted. The reason for it is that the heated gas blown continuously strikes directly on a particular portion of the inner peripheral wall of the agitation vessel, and so heat is accumulated in that portion to generate a heat spot. When the colored resin particles come into contact with the heat spot, the colored resin particles are fusion-bonded to the inner wall surface of the agitation vessel or to one another by the heat of the heat spot.

When the colored resin particles are thermally fusion-bonded to the inner wall surface of the agitation vessel or to one another, the maintenance of the dryer becomes complicated, and moreover the toner properties of the resulting toner may be deteriorated due to mixing of the fusion-bonded particles and/or deterioration by heat of the colored resin particles.

Figure 7:
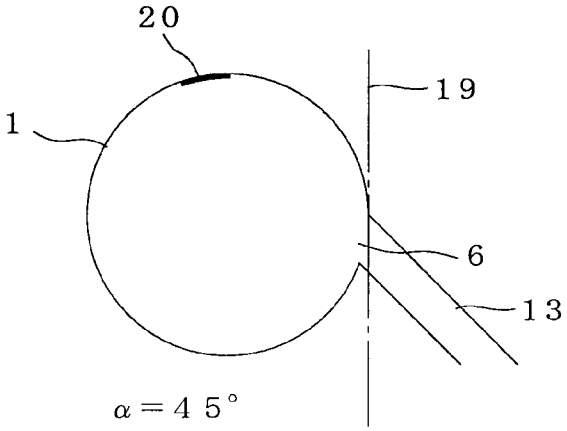
FIG. 7 illustrates a case where the blowing angle α is 45°.

FIG. 7 illustrates a case where the blowing angle is 45°. Even in this case, a heat spot 20 is easy to be generated on the inner peripheral surface of the agitation vessel 1. Thus, in the present invention, the blowing angle $\alpha$ is set within a range from 0 to 30°.

When the blowing angle $\alpha$ is from 0° to less than 3°, the main axis of the gas inlet line communicating with the gas inlet port is substantially in a tangential direction to the inner peripheral surface of the agitation vessel, so that a swirl flow is easy to be formed by the heated gas blown, whereby the drying efficiency becomes good, but on the other hand a heat spot is easy to be generated upon continuous operation. When the blowing angle $\alpha$ is set widely on the other hand, disorder of an air current within the agitation vessel becomes great, so that the dispersion or mixing of the wet colored resin particles becomes insufficient to lower the drying efficiency.

The blowing angle $\alpha$ is preferably set within a range from 3 to 30° in that the drying efficiency by the swirl flow and the prevention of generation of the heat spot are balanced with each other. This blowing angle $\alpha$ is more preferably 5 to 25°, still more preferably 6 to 20°, particularly preferably 7 to 15°. The blowing angle $\alpha$ is set within the above range, whereby the swirl flow and the turbulent flow can be balanced within the agitation vessel, and the generation of the heat spot can be inhibited without lowering the drying efficiency. Accordingly, continuous operation using the same dryer can be stably performed.

The gas inlet port 6 may be so constructed that its opening on the side of the agitation vessel 1 can be opened and closed by a valve disk. This valve disk is formed in such a manner that a tip surface of the valve disk is almost flush with the peripheral surface of the agitation vessel 1 in a closed state.

The rotary type agitating device desirably has a structure that a chopper shaft 9, on which a plurality of chopper blades 10, 10, 10 . . . has been arranged in its axial direction, is rotatably pivoted in the inner wall surface of the agitation vessel 1 at both ends thereof and arranged above the agitating vane 3 within the agitation vessel 1. In the drying step, the chopper shaft 9 is rotated by an electric motor 11, whereby the drying can be conducted while pulverizing aggregates of the wet colored resin particles by the chopper blades 10, 10, 10 . . . rotated attending on the rotation of the chopper shaft. In other words, the wet colored resin particles forming a fluidized bed show a tendency to gather and aggregate in the vicinity of the center of the agitating vane 3. However, the chopper blades 10 are used to pulverize the aggregates, whereby the formation of the aggregates can be prevented to enhance the drying efficiency.

More specifically, the chopper blades 10 are arranged in a state free of interference with the agitating vane 3 rotating at the bottom of the agitation vessel 1, so that the wet colored resin particles are formed into a fluidized bed of a complicated flow by an inversion (turning over) flow by the rotation of the agitating vane 3 and a jumping-up action by the rotation of the chopper blades 10 in such a manner that the wet colored resin particles easy to become a mass at a place near to the center of the agitating vane, which is hard to be affected by centrifugal force attending on the rotation of the agitating vane 3, can be surely pulverized.

A mixed gas containing the heated gas and water volatilized out of the wet colored resin particles is discharged outside the agitation vessel 1 through the gas outlet line 8 from the gas outlet port 7. The agitating device may be so constructed that a cyclone or bag filters 12, 12, 12 . . . are arranged at an upper portion within the agitation vessel 1 in such a manner that the colored resin particles are not discharged outside together with the flow of the mixed gas at this time, whereby the colored resin particles remain within the agitation vessel 1.

In the drying step, (a) the wet colored resin particles are poured into a rotary vane type agitating device having an agitation vessel, a rotating drive shaft and an agitating vane and having a structure that the agitating vane fixed to the rotating drive shaft extending through a bottom wall of the agitation vessel is arranged at a bottom of the agitation vessel, and at least one gas inlet port and at least one gas outlet port are arranged at a lower portion of the agitation vessel and an upper portion of the agitation vessel, respectively, and (b) the wet colored resin particles are dried by a method, in which the wet colored resin particles are agitated by the agitating vane (rotary vane) within the agitation vessel while supplying a heated gas from the gas inlet port, thereby forming a fluidized bed of the wet colored resin particles, and a mixed gas containing the heated gas supplied and water volatilized out of the wet colored resin particles is discharged from the gas outlet port to the outside.

At this time, the heated gas is supplied from the gas inlet port by a method, in which a main axis of a gas inlet line communicating with the gas inlet port is set to an angle within a range from 0 to 30° with a tangential direction to an inner peripheral surface of the agitation vessel, and the heated gas is blown into the agitation vessel from the gas inlet port along a direction of the main axis of the gas inlet line. This respect is as described above. In the present invention, furthermore, drying conditions are controlled in such a manner that the temperature of the mixed gas discharged from the gas outlet port falls within a range from 20 to 60° C.

In the rotary vane type agitating device, the wet colored resin particles are introduced into the agitation vessel 1 from the input port 17 in one lot to conduct a drying treatment by a batch system. When the electric motor for drive 4 is operated, the rotating drive shaft 2 is rotated through the power transmission 5 to rotate the agitating vane 3 attending on this rotation. The wet colored resin particles are transferred to a radial direction by the rotation of the agitating vane 3 and jumped up by the rake faces 18 of the vane pieces to undergo inversion motion repeatedly. The heated gas is blown against the wet colored resin particles undergoing this inversion motion repeatedly as a swirl flow from the gas inlet port 6 provided in the peripheral wall surface of the agitation vessel 1 to pulverize and dry the wet colored resin particles. A rotating direction 14 of the agitating vane 3 is illustrated in FIG. 2.

If the introduction speed of the heated gas is too slow, the wet colored resin particles are pressed against the peripheral wall surface of the agitation vessel 1 by the rotation of the agitating vane 3 to enter the gas inlet port 6. If the introduction speed of the heated gas is too fast, the wet colored resin particles are not caught in the flow of the heated gas, and so a stable operation is impaired. The flow rate (also referred to as "hot gas quantity") of the heated gas is preferably 1 to 10

$m^3$/hr, more preferably 2 to 8 $m^3$/hr, particularly preferably 2 to 5 $m^3$/hr. The flow rate of the heated gas based on the dry weight of the wet colored resin particles is preferably 0.4 to 4 $m^3$/dry·kg·hr, more preferably 0.8 to 3.4 $m^3$/dry·kg·hr, still more preferably 1 to 2.5 $m^3$/dry·kg·hr.

Examples of the heated gas include nitrogen gas, air and other inert gases than the nitrogen gas. Among these, the nitrogen gas is preferred because it is cheap and inert. The heated gas is introduced into the agitation vessel by means of a blower. The inert gas such as nitrogen gas may be recovered from the mixed gas discharged from the gas outlet port to reuse it. The gas discharged from the gas outlet port is a mixed gas containing water volatilized out of the wet colored resin particles together with the heated gas introduced. When an inert gas such as nitrogen gas is used as the heated gas, the mixed gas discharged is passed through a condenser to remove water by condensation and separate the inert gas such as nitrogen gas from the mixed gas.

The temperature of the heated gas is preferably a temperature within a range from a temperature (Tg−20° C.) lower by 20° C. than the glass transition temperature (Tg) of a binder resin component making up the colored resin particles to a temperature (Tg+50° C.) higher by 50° C. than the glass transition temperature when measured by a temperature sensor arranged at the gas inlet port. The temperature of the heated gas is within a range more preferably from (Tg−15° C.) to (Tg+40° C.), still more preferably from (Tg−10° C.) to (Tg+30° C.). If the temperature of the heated gas is too high, fusion bonding of the colored resin particles to the inner wall of the rotary vane type agitating device is easy to occur, or thermal fusion bonding or aggregation among the colored resin particles is easy to occur. If the temperature of the heated gas is too low, the drying efficiency is lowered, and it is difficult to control the temperature of the gas outlet port within a predetermined range.

In order to enhance the drying efficiency, it is preferable to adopt a method, in which a heated gas heated to a temperature within a range from a temperature not lower than the glass transition temperature of the binder resin component making up the colored resin particles to a temperature higher by 50° C. than the glass transition temperature is introduced from the gas inlet port to start drying, and at the point of time the relative humidity of a mixed gas discharged from the gas outlet port has reached 40 to 80%, the temperature of the heated gas introduced from the gas inlet port is lowered to a temperature within a range from a temperature lower by 20° C. than the glass transition temperature to the glass transition temperature to continue the drying.

More specifically, a heated gas controlled within a range preferably from Tg to (Tg+50° C.), more preferably from (Tg+5° C.) to (Tg+40° C.), still more preferably from (Tg+10° C.) to (Tg+30° C.) is introduced from the gas inlet port to start drying. Since water volatilized out of the wet colored resin particles is discharged together with the heated gas from the gas outlet port to the outside with the progress of the drying, the relative humidity of the mixed gas discharged from the gas outlet port is gradually lowered. The relative humidity of the mixed gas is measured by a humidity sensor arranged at the gas outlet port, and at the point of time the relative humidity has reached preferably 40 to 80%, more preferably 45 to 75%, still more preferably 50 to 70%, the temperature of the heated gas introduced from the gas inlet port is lowered to a temperature within a range from a temperature lower by 20° C. (preferably, Tg−10° C.) than Tg to the glass transition temperature to continue the drying.

When the method of controlling the temperature of the heated gas in this manner is adopted, a heating and drying temperature for the wet colored resin particles in a state high in water content can be raised to accelerate the drying speed, and moreover the temperature of the heated gas can be lowered as the water content decreases, thereby preventing fusion bonding or aggregation of the colored resin particles. In short, at the initial stage of drying, the temperature of the colored resin particles themselves is not very raised due to heat of vaporization by evaporation of water even when the temperature of the heated gas is raised, so that fusion bonding or aggregation is not caused.

When the jacket is used, the temperature (jacket temperature) of a medium (for example, hot water) circulated through the jacket is controlled to preferably 30 to 60° C., more preferably 35 to 55° C., still more preferably 40 to 50° C. The agitation vessel is heated by the jacket, whereby the drying efficiency can be improved.

The rotating speed of the agitating vane is preferably 50 to 300 rpm, more preferably 60 to 200 rpm, still more preferably 80 to 150 rpm. The tip speed of the agitating vane is preferably 0.3 to 5 m/s, more preferably 0.5 to 3 m/s, still more preferably 0.8 to 2.5 m/s.

When the chopper blades are used, the rotating speed thereof is preferably 300 to 3,000 rpm, more preferably 400 to 2,000 rpm, still more preferably 500 to 1,500 rpm. The tip speed of the chopper blades is preferably 0.5 to 10 m/s, more preferably 1 to 8 m/s, still more preferably 2 to 5 m/s.

The temperature of the mixed gas discharged from the gas outlet port is controlled to 20 to 60° C. when measured by a temperature sensor arranged at the gas outlet port. This temperature is preferably 20 to 55° C., more preferably 20 to 50° C. In many cases, the temperature of about 23 to 40° C. can yield good results. If the temperature of the mixed gas discharged from the gas outlet port is too high, the fusion bonding or aggregation of the colored resin particles is easy to occur. If the temperature is too low, the drying efficiency is lowered.

When the drying step is continuously conducted under high-temperature conditions, fusion bonding of the colored resin particles to the inner wall of the dryer, or fusion bonding among the colored resin particles is easy to occur, so that the maintenance of the dryer becomes complicated, and moreover the resulting toner tends to deteriorate its toner properties due to mixing of the fusion-bonded particles or aggregates and/or deterioration by heat of the colored resin particles. When the drying method of a continuous system is adopted, a part of the colored resin particles tend to remain in the dryer for a long period of time, and so fusion bonding, aggregation and/or deterioration by heat is easy to occur.

On the other hand, when the drying step is conducted by a batch system like, for example, vacuum drying or under low-temperature conditions, the drying time becomes markedly long, so that the production efficiency is lowered. When the method of drying under high-temperature conditions by the batch system is adopted, fusion bonding or aggregation of the colored resin particles become marked.

To the contrary, according to the production process of the present invention, the colored resin particles can be rapidly dried while preventing the fusion bonding or aggregation thereof by adopting the specified drying method and controlling the drying conditions though the batch system is adopted, and colored resin particles exhibiting excellent toner properties can be collected with high yield.

6. External Additive Addition Step

The dry colored resin particles can be used as a toner component for various kinds of developers. In order to improve flowability or impart abrasiveness, however, an external additive is mixed with the colored resin particles and attached to the surfaces thereof. In particular, in order to use the colored resin particles as a non-magnetic one-component developer, inorganic particles and/or organic resin particles functioning as a flowability improver, an abrasive and/or the like are preferably externally added.

Examples of the inorganic particles include silicon dioxide (silica), aluminum oxide (alumina), titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, and core-shell type particles in which the core is composed of a styrene polymer, and the shell is composed of a methacrylic ester copolymer.

Among these, the inorganic oxide particles are preferred, with silicon dioxide (silica) being particularly preferred. The surfaces of the inorganic fine particles may be subjected to a hydrophobicity-imparting treatment, and silicon dioxide particles subjected to the hydrophobicity-imparting treatment are particularly preferred. Two or more of the external additives may be used in combination. When the external additives are used in combination, it is preferable to use two or more kinds of inorganic particles or inorganic particles and organic resin particles, which are different in average particle diameter from each other, in combination. No particular limitation is imposed on the amount of the external additive used. However, it is generally 0.1 to 6 parts by weight per 100 parts by weight of the colored resin particles.

In order to attach the external additive to the colored resin particles, it is generally adopted to charge the colored resin particles and the external additive into a mixer equipped with a high-speed rotating agitation vane, such as a Henschel mixer, to agitate them. However, this method is complicated in operation because the dry colored resin particles after the drying step are required to be transferred to another mixer or agitating device to mix them with the external additive.

On the other hand, when a mixer used in a drying step, such as a planetary motion type mixing dryer [manufactured by Shinko Pantec Co., Ltd., trade name: SV MIXER (trademark)], is used to mix the colored resin particles with the external additive within the same mixer after the drying step, the external additive cannot be uniformly and sufficiently attached to the surfaces of the colored resin particles, so that only a toner unsatisfactory in toner properties such as initial charge level can be obtained.

In the present invention, subsequently to the drying step, the external additive addition step of mixing the external additive is conducted within the same rotary vane type agitating device as that used in the drying step. In order to uniformly mix the dry colored resin particles with the external additive within the rotary vane type agitating device, the tip speed of the agitating vane is preferably increased. The tip speed of the agitating vane is preferably 10 to 80 m/s, more preferably 15 to 60 m/s.

When the chopper blades are used, the rotating speed thereof is preferably 300 to 3,000 rpm, more preferably 400 to 2,000 rpm, still more preferably 500 to 1,500 rpm. The tip speed of the chopper blades is preferably 0.5 to 10 m/s, more preferably 1 to 8 m/s, still more preferably 2 to 5 m/s.

The tip speed of the agitating vane is increased, and the chopper blades are used to accelerate the mixing, whereby the treatment time in the external additive addition step can be shortened to generally about 5 to 30 minutes, preferably about 8 to 20 minutes.

The temperature within the agitating device in the external additive addition step is generally a temperature within a range from at least 5° C. to lower than the glass transition temperature (Tg) of the binder resin component making up the colored resin particles, preferably a temperature within a range from at least 10° C. to lower than (Tg−5° C.). When the addition of the external additive is conducted at a temperature higher than the above range, aggregation of the resulting toner is easy to occur. When the addition of the external additive is conducted at a temperature lower than the above range on the other hand, dewing occurs, and so the addition of the external additive may not be uniformly conducted in some cases. When the external additive addition step is performed within the same rotary vane type agitating device just after the drying step, the temperature of the colored resin particles heated in the drying step is near to Tg of the binder resin component. When the jacket is used in the external additive addition step, the temperature (jacket temperature) of a medium (for example, cold water) circulated through the jacket is preferably controlled within a range from 5 to 50° C.

EXAMPLES

The present invention will hereinafter be described more specifically by the following Examples and Comparative Examples. However, the present invention is not limited to these examples only. All designations of "part" or "parts" and "%" in the following Examples and Comparative Examples mean part or parts by weight and % by weight unless expressly noted. Measuring methods or evaluating methods of physical properties and properties are as follows.

(1) Measuring Method of Volume Average Particle Diameter:

The volume average particle diameter (dv) of colored polymer particles is measured by means of a particle diameter meter (manufactured by Beckmann Coulter Co., trade name: MULTISIZER). The measurement by this MULTISIZER) was conducted under conditions of an aperture diameter=100 μm, a medium=Isothone, a concentration=10% and the number of particles measured=100,000 particles. The vol. % of colored resin particles having a particle diameter of at least 20 μm was also measured by MULTISIZER.

(2) Measuring Method of Glass Transition Temperature:

The measurement of a glass transition temperature (Tg) of colored resin particles was conducted according to the following method. Colored resin particles (about 10 mg) obtained by drying were precisely weighed, a differential scanning calorimeter (manufactured by SII Nanotechnology Inc., trade name: DSC6220) was used, the measuring sample precisely weighed was put into an aluminum pan according to ASTM D 3418-97, and a vacant aluminum pan was used as a reference to measure a glass transition temperature of the colored resin particles at a measuring temperature within a range from 0 to 150° C. under conditions of a heating rate of 10° C./min.

(3) Measuring Method of Water Content:

Measurements of water contents in colored resin particles before, during and after drying were conducted according to the following procedure. The weight (Ag) of an aluminum pan was measured, and undried colored resin particles were sampled on the aluminum pan to measure the total weight (Bg) of the aluminum pan and the undried colored resin particles. The aluminum pan was put into a dryer to dry the undried colored resin particles for 3 hours at 105° C. Thereafter, the total weight (Cg) of the aluminum pan and the colored resin particles dried was measured.

The water content in the colored resin particles was expressed as a concentration (% by weight) according to the following equation (1). In this measuring method, when the water content becomes a measured value not higher than 0.1% by weight, an error in measurement becomes great, and so this case is expressed as "at most 0.1%" 0.1%).

$$\text{Water content}=[(B-C)/(B-A)]\times 100 \quad (1)$$

(4) Measuring Method of Charge Level:

After a printer (printing speed: 4 sheets/min) of a nonmagnetic one-component development system was charged a developer and left to stand for a day under an environment of 23° C. in temperature and 50% in relative humidity, a halftone print pattern was then printed by 5 sheets. Thereafter, the developer on a developing roller was sucked by a suction type charge level meter to measure a charge level (μC/g) per unit weight from a charge level of the developer sucked and an amount of the developer sucked.

(5) Testing Method of Printing Durability:

A commercially available printer of a nonmagnetic one-component development system was used, paper for printing was set in the printer, and developer was put into a developing unit thereof. After the printer was left to stand for 24 hours under a normal-temperature and normal-humidity environment of 23° C. in temperature and 50% in relative humidity, continuous printing was conducted under the same environment at a printing density of 5%. Solid printing (printing density: 100%) was conducted every 500 sheets of paper in the continuous printing to measure a printing density of the solid-printed area by means of a reflection type image densitometer (manufactured by McBeth Co., trade name: RD918). Thereafter, white solid printing (printing density: 0%) was conducted, the printer was stopped in the middle of the white solid printing, a developer remaining in a non-image area on a photosensitive member after development was attached to a pressure-sensitive adhesive tape (product of Sumitomo 3M Limited, trade name: SCOTCH MENDING TAPE 810-3-18), and this tape was stuck on paper for printing.

A whiteness degree B of the paper for printing, on which the pressure-sensitive adhesive tape had been stuck, was then measured by means of a whiteness meter (manufactured by Nippon Denshoku K.K.). Only an unused pressure-sensitive adhesive tape was stuck on paper for printing to measure a whiteness degree A thereof likewise. A difference (B−A) between these whiteness degrees was regarded as a fog value (%). The smaller fog value indicates that fog is less, and image quality is better. The number of paper sheets, on which the continuous printing could be conducted while retaining such image quality that the image density is 1.3 or higher, and the fog value is 3% or lower, was determined to regard such number of paper sheets as the number of paper sheets that passed the printing durability test.

Example 1

1. Polymerizable Monomer Composition for Core

A polymerizable monomer mixture (calculated Tg of a copolymer obtained by copolymerizing these monomers=55° C.) for core composed of 80.5 parts of styrene and 19.5 parts of n-butyl acrylate, 0.3 parts of a polymethacrylic ester macromonomer (product of Toagosei Co., Ltd., trade name: "AA6", Tg=94° C.), 0.5 parts of divinylbenzene, 1.2 parts of t-dodecylmercaptan and 7 parts of carbon black (product of Mitsubishi Chemical Corporation, trade name: "#25B") were subjected to wet grinding by means of a media type wet grinding machine. One part of a charge control resin (product of Fujikura Kasei Co., Ltd., trade name "ACRYBASE FCA-207P") and 5 parts of ester wax (product of NOF CORPORATION, trade name "WEP-7") were added, mixed and dissolved in the monomer mixture after the wet grinding to prepare a polymerizable monomer composition for core.

2. Colloidal Dispersion of Magnesium Hydroxide

An aqueous solution with 6.2 parts of sodium hydroxide dissolved in 50 parts of ion-exchanged water was gradually added to an aqueous solution with 10.2 parts of magnesium chloride dissolved in 250 parts of ion-exchanged water under stirring to prepare a colloidal dispersion of magnesium hydroxide.

3. Polymerizable Monomer for Shell

Two parts of methyl methacrylate (Tg of polymer=105° C.) and 65 parts of water were subjected to a finely dispersing treatment by an ultrasonic emulsifier to obtain an aqueous dispersion of a polymerizable monomer for shell.

4. Formation of Droplets

After the colloidal dispersion (amount of colloid: 4.0 parts) of magnesium hydroxide prepared above was poured into an agitation vessel, the polymerizable monomer composition for core was poured. The contents were then agitated, whereby the polymerizable monomer composition for core was dispersed as droplets in the dispersion. After the resultant dispersion was agitated until the droplets of the polymerizable monomer composition for core became stable, 6 parts of t-butyl peroxy-isobutylate (product of NOF CORPORATION., trade name: "PERBUTYL IB") was added to the dispersion. Droplets of the polymerizable monomer composition for core were formed by a method, in which the dispersion within the agitation vessel is caused to pass through a high-shearing force agitating device [manufactured by Ebara Corporation, trade name: "EBARA MILDER MDN303V" (trademark)] equipped with a rotor rotating at 15,000 rpm, and the dispersion passed is returned to the agitation vessel to circulate it.

5. Polymerization Step

A reactor equipped with agitating blades was charged with the dispersion with the droplets of the polymerizable monomer for core dispersed therein to initiate a polymerization reaction at 85° C. After a conversion into a polymer reached almost 100%, an aqueous dispersion with 0.3 parts of a water-soluble initiator [product of Wako Pure Chemical Industries, Ltd., trade name: "VA-086"; 2,2'-azobis[2-methyl-N-(2-hydroxyethyl)-propionamide]] dissolved in the aqueous dispersion of the polymerizable monomer for shell was added into the reactor. After the polymerization was continued for 4 hours, the reaction was stopped to obtain an aqueous dispersion containing core-shell type colored polymer particles.

6. Washing Step

Sulfuric acid was added while agitating the aqueous dispersion of the colored polymer particles obtained above to adjust the pH of the aqueous dispersion to 4 to 5, thereby conducting acid washing for 10 minutes at 25° C. This aqueous dispersion was filtered and dehydrated to obtain a wet cake. To the thus-obtained wet cake, was added 200 parts of ion-exchanged water, and the resultant mixture was agitated for at least 30 minutes to prepare an aqueous dispersion. This step is called a reslurrying step. After this reslurrying step was repeated once more, the resultant aqueous dispersion was filtered and dehydrated to obtain a wet cake. The water content in the thus-obtained wet cake (wet colored polymer particles) was 20.5%.

7. Drying Step

A rotary vane type agitating dryer [manufactured by Fukae Powtec Corporation, DYNAMIC DRYER (trademark) DD-10 Model] was charged with 3 kg of the wet colored polymer particles obtained above to dry the polymer particles for 2 hours by a batch system. The jacket temperature, the rotating speed of an agitating vane (rotary vane) and the rotating speed of chopper blades were controlled to 47° C., 120 rpm (tip speed: 1.9 m/s) and 1,000 rpm (tip speed: 3.6 m/sec), respectively. Heated nitrogen gas was introduced into this rotary vane type dryer by controlling the rotating speed of a blower to 1,500 rpm (hot gas quantity: 3.2 $m^3$/hr) to conduct the drying for 2 hours.

Two sets of gas inlet ports 6 and 6' and gas inlet lines 13 and 13' communicating with the respective ports were arranged in the agitation vessel 1 in such a manner that the two gas inlet ports 6 and 6' are almost opposite to each other as illustrated in FIG. 2. Each blowing angle $\alpha$ was set to 0° (tangential direction to an inner peripheral surface of the dryer).

In this drying step, the colored polymer particles were sampled every 15 minutes to measure the content of water therein. The relative humidity of a mixed gas discharged from a gas outlet port of the rotary vane type agitating dryer was monitored at the same time. Details of drying conditions and results are shown in Table 1.

8. Developer

Toner

To 100 parts of the dry colored polymer particles thus obtained were added 0.5 parts of fine silica particles (product of Cabot Co., trade name: "TG820F") subjected to a hydrophobicity-imparting treatment with cyclosilazane, the number average particle diameter of primary particles of which was 7 nm, and 1.5 parts of fine silica particles (product of Nippon Aerosil Co., Ltd., trade name: "NEA50") subjected to a hydrophobicity-imparting treatment with amino-modified silicone oil, and these components were mixed by means of a Henschel mixer to obtain a non-magnetic one-component developer (hereinafter referred to as "toner"). The toner thus obtained was used to test its toner properties. The results are shown in Table 1.

Example 2

A drying step was conducted in the same manner as in Example 1 except that the drying conditions in the drying step of Example 1 were changed as shown in Table 1, thereby obtaining a non-magnetic one-component developer (toner). At the beginning of the drying step, the temperature of the heated nitrogen gas introduced from the gas inlet port was controlled to 70° C., and the temperature of the heated nitrogen gas introduced from the gas inlet port was lowered to 50° C. at the point of time the monitored relative humidity of the mixed gas discharged during the drying had reached 65%. The hot gas quantity (rotating speed of the blower) was controlled in such a manner that the temperature of the gas outlet port become 30° C. The drying conditions and results are shown in Table 1.

Example 3

A drying step was conducted in the same manner as in Example 1 except that the drying conditions in the drying step of Example 1 were changed as shown in Table 1, thereby obtaining a non-magnetic one-component developer (toner). At the beginning of the drying step, the temperature of the heated nitrogen gas introduced from the gas inlet port was controlled to 80° C., and the temperature of the heated nitrogen gas introduced from the gas inlet port was lowered to 50° C. at the point of time the monitored relative humidity of the mixed gas discharged during the drying had reached 65%. The hot gas quantity (rotating speed of the blower) was controlled in such a manner that the temperature of the gas outlet port become 35° C. The drying conditions and results are shown in Table 1.

Example 4

A drying step was conducted in the same manner as in Example 1 except that the drying conditions in the drying step of Example 1 were changed as shown in Table 1, thereby obtaining a non-magnetic one-component developer (toner). At the beginning of the drying step, the temperature of the heated nitrogen gas introduced from the gas inlet port was controlled to 70° C., and the temperature of the heated nitrogen gas introduced from the gas inlet port was lowered to 50° C. at the point of time the monitored relative humidity of the mixed gas discharged during the drying had reached 65%. The hot gas quantity (rotating speed of the blower) was controlled in such a manner that the temperature of the gas outlet port become 25° C. The drying conditions and results are shown in Table 1.

Example 5

A drying step was conducted in the same manner as in Example 3 except that each gas inlet port and a gas inlet line communicating with it were designed in such a manner that each blowing angle $\alpha$ becomes 10°. The results are shown in Table 1.

Comparative Example 1

In the drying step of Example 1, vacuum drying was conducted by means of a rotary vane type agitating dryer [manufactured by Fukae Powtec Corporation, HIGH SPEED MIXER DMR-1]. The vacuum drying was conducted under conditions of a degree of vacuum of 4 to 5 kPa. The results are shown in Table 1.

Comparative Example 2

In Example 1, the rotary vane type agitating dryer was changed to an agitating fluidized-bed dryer (manufactured by Hosokawa Micron Corp., DRY MEISTER), and the temperature of the gas inlet port and the temperature of the gas outlet port were controlled so as to be shown in Table 1 to conduct continuous drying. The amount of the wet colored polymer particles fed, the tip speed of the agitating rotor and the speed of the hot gas were controlled to 16 kg/hr, 10 msec and 2.4 msec, respectively. The results are shown in Table 1.

TABLE 1

| | Example | | | | | Comp. Example | |
|---|---|---|---|---|---|---|---|
| | 1 | 2 | 3 | 4 | 5 | 1 | 2 |
| Drying conditions | | | | | | | |
| Kind of dryer | A | A | A | A | A | A | B |
| Jacket temperature (° C.) | 47 | 47 | 47 | — | 47 | 47 | — |
| Gas inlet port temperature (° C.) | 50 | 70→50 | 80→50 | 70→50 | 80→50 | Vacuum | 110 |
| Gas outlet port temperature (° C.) | 25 | 30 | 35 | 25 | 35 | drying | 70 |
| Rotating speed of agitating vane (rpm) | 120 | 120 | 120 | 120 | 120 | — | — |
| Rotating speed of chopper blades (rpm) | 1000 | 1000 | 1000 | 1000 | 1000 | — | — |
| Blowing angle (°) | 0 | 0 | 0 | 0 | 10 | — | — |
| Drying time/water content (%) | | | | | | | |
| 0 min | 20.5 | 20.5 | 20.5 | 20.5 | 20.5 | 20.5 | 20.5 |
| 15 min | 15.6 | 13.2 | 10.3 | 17.0 | 11.4 | 18.3 | — |
| 30 min | 8.6 | 4.2 | 0.2 | 9.3 | 1.5 | 13.3 | — |
| 45 min | 2.5 | ≤0.1 | ≤0.1 | 1.2 | ≤0.1 | 10.3 | — |
| 60 min | ≤0.1 | ≤0.1 | ≤0.1 | ≤0.1 | ≤0.1 | 7.5 | — |
| 75 min | ≤0.1 | ≤0.1 | ≤0.1 | ≤0.1 | ≤0.1 | 5.7 | — |
| 90 min | ≤0.1 | ≤0.1 | ≤0.1 | ≤0.1 | ≤0.1 | 4.0 | — |
| 105 min | ≤0.1 | ≤0.1 | ≤0.1 | ≤0.1 | ≤0.1 | 2.7 | — |
| 120 min | ≤0.1 | ≤0.1 | ≤0.1 | ≤0.1 | ≤0.1 | 1.9 | ≤0.1 |
| Fusion bonding to inner wall of dryer | None | None | None | None | None | None | Occurred |
| After 10-batch continuous operation | Occurred | Occurred | Occurred | Occurred | None | — | — |
| Colored resin particles | | | | | | | |
| dv before drying (μm) | 7.6 | 7.6 | 7.6 | 7.6 | 7.6 | 7.6 | 7.6 |
| dv after drying (μm) | 7.6 | 7.6 | 7.6 | 7.6 | 7.6 | 7.6 | 7.6 |
| Particles of at least 20 μm before drying (vol. %) | 0.4 | 0.4 | 0.4 | 0.4 | 0.4 | 0.4 | 0.4 |
| Particles of at least 20 μm after drying (vol. %) | 0.6 | 1 | 0.9 | 0.7 | 0.4 | 0.4 | 1.2 |
| Toner properties | | | | | | | |
| Initial charge level (μC/g) | 55 | 56 | 54 | 56 | 56 | — | 42 |
| Printing durability (sheets) | 13000 | 13000 | 13000 | 13000 | 13000 | — | 9000 |

(Note)
A: Rotary vane type agitating dryer
B: Agitating fluidized-bed dryer

[Consideration]

When the vacuum drying was conducted (Comparative Example 1), the drying efficiency was poor, and the wet colored polymer particles were not sufficiently dried even after dried for 120 minutes, and so measurement of toner properties could not be conducted. When the temperature of the heated gas and the temperature of the mixed gas discharged were made high (Comparative Example 2), fusion bonding of the colored resin particles to the inner wall of the dryer was observed, and the initial charge level was lowered and the printing durability was also deteriorated when the toner properties were measured under the same conditions.

On the other hand, when the drying was conducted according to the process of the present invention, the water content was reduced to at most 0.1% by weight by drying for 45 to 60 minutes, excellent drying efficiency was exhibited, and fusion bonding of the colored resin particles to the inner wall of the dryer, and fusion bonding among the colored resin particles and their deterioration by heat could be prevented. As a result, toners excellent in initial charge level and printing durability could be provided.

When the blowing angle α of the heated gas was set to 10° (Example 5) compared with the case where the blowing angle α was set to 0° (tangential direction to the inner peripheral surface of the dryer) (Examples 1 to 4), it is understood that fusion bonding of the colored resin particles to the inner peripheral surface of the agitation vessel is not observed even after 10-batch continuous operation according to the same formulation is conducted, and so stability to continuous operation is markedly improved. The case where the blowing angle α is set to 5°, 15°, 25° or 30° can also achieve the same result as in Example 5.

Figure 3:
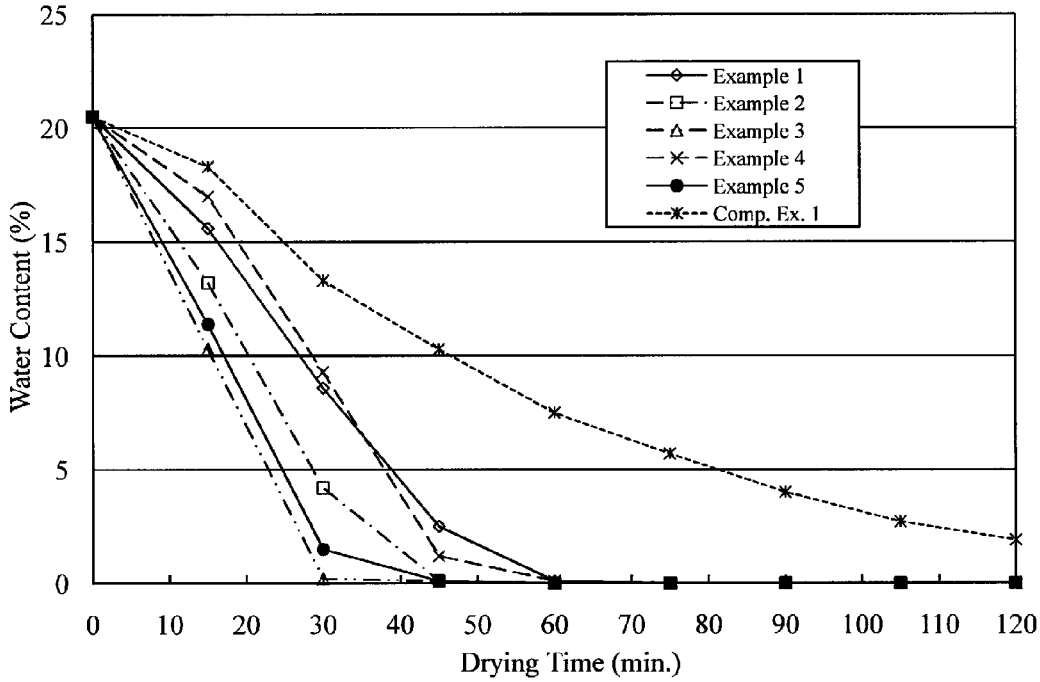
FIG. 3 diagrammatically illustrates the relationship between a drying time and a water content in Examples 1 to 5 and Comparative Example 1.

FIG. 3 diagrammatically illustrates the relationship between a drying time and a water content in Examples 1 to 5 and Comparative Example 1.

Example 6

1. Polymerizable Monomer Composition for Core

Seventy-five parts of styrene and 25 parts of n-butyl acrylate as monovinyl monomers, 5 parts of copper phthalocyanine (product of Dainichiseika Color & Chemicals Mfg. Co., Ltd., trade name: CHROMOFINE BLUE 6352) as a cyan colorant, 1 part of a charge control resin (styrene/acrylic resin, product of Fujikura Kasei Co., Ltd., trade name: FCA-161P"), and 5 parts of ester wax (product of NOF CORPORATION, trade name: WEP-7) were agitated and mixed to prepare a polymerizable monomer composition for core.

2. Colloidal Dispersion of Magnesium Hydroxide

An aqueous solution with 6.2 parts of sodium hydroxide dissolved in 50 parts of ion-exchanged water was gradually added to an aqueous solution with 11.0 parts of magnesium chloride dissolved in 200 parts of ion-exchanged water under stirring to prepare a dispersion of magnesium hydroxide colloid (colloid of a hardly water-soluble metal hydroxide).

3. Formation of Droplets

After the colloidal dispersion of magnesium hydroxide prepared above was poured into an agitation vessel, the polymerizable monomer composition for core was poured. The contents were then agitated, whereby the polymerizable monomer composition for core was dispersed as droplets (primary droplets) in the dispersion. After the resultant dispersion was agitated until the droplets of the polymerizable monomer composition for core became stable, 5 parts of t-butyl peroxy-2-ethylbutanoate (product of AKZO NOBEL CO., trade name: TRIGONOX 27) as a polymerization initiator, 1 part of tetraethylthiuram disulfide as a molecular weight modifier and 0.4 parts of divinylbenzene as a crosslinking agent were added to the dispersion, and the resultant mixture was agitated for 1 minute at 15,000 rpm under high shear by means of an in-line type emulsifying and dispersing machine (manufactured by Pacific Machinery & Engineering Co., Ltd., trade name: CAVITRON) to form droplets (secondary droplets) of the polymerizable monomer composition for core. After the droplets of the polymerizable monomer composition for core were formed, 0.1 parts of pyrogallol (product of Wako Pure Chemical Industries, Ltd.) was added, and the dispersion was further agitated.

4. Polymerization Step

A reactor equipped with agitating blades was charged with the dispersion with the droplets of the polymerizable monomer for core dispersed therein, and the temperature was raised to 90° C. to initiate a polymerization reaction. At the time a conversion into a polymer had reached 95%, 2.1 parts of methyl methacrylate (Tg of polymer=105° C.) as a polymerizable monomer for shell and 0.21 parts of 2,2'-azobis[2-methyl-N-(2-hydroxyethyl)-propionamide] (product of Wako Pure Chemical Industries, Ltd., trade name: VA-086) that is a water-soluble initiator for shell dissolved in 20 parts of ion-exchanged water were added into the reactor to continue the reaction for 3 hours at 90° C. Thereafter, the reaction was stopped to obtain an aqueous dispersion of colored polymer particles (colored polymer particles) having a core-shell structure.

5. Washing Step

Sulfuric acid was added while agitating the aqueous dispersion of the colored resin particles obtained above to adjust the pH of the aqueous dispersion to 4 to 5, thereby conducting acid washing for 10 minutes at 25° C. This aqueous dispersion was filtered and dehydrated to obtain a wet cake. To the thus-obtained wet cake, was added 200 parts of ion-exchanged water, and the resultant mixture was agitated for at least 30 minutes to prepare an aqueous dispersion. This step is called a reslurrying step. After this reslurrying step was repeated once more, the resultant aqueous dispersion was filtered and dehydrated to obtain a wet cake. The water content in the thus-obtained wet cake (wet colored resin particles) was 20.3%.

6. Drying Step

A rotary vane type agitating dryer [manufactured by Fukae Powtec Corporation, DYNAMIC DRYER (trademark) DD-10 Model] was charged with 2 kg of the wet colored resin particles obtained above to dry them by a batch system under the following drying conditions.

The jacket temperature, the rotating speed of an agitating vane and the rotating speed of chopper blades were controlled to 47° C., 120 rpm (tip speed: 1.9 m/s) and 1,000 rpm (tip speed: 3.6 m/sec), respectively. Heated nitrogen gas was introduced into this rotary vane type dryer by controlling the rotating speed of a blower to 1,500 rpm (hot gas quantity: 3.2 $m^3$/hr) to conduct the drying for 45 minutes. At the beginning of the drying step, the temperature of the heated nitrogen gas introduced from the gas inlet port was controlled to 70° C., and the temperature of the heated nitrogen gas introduced from the gas inlet port was lowered to 50° C. at the point of time the monitored relative humidity of the mixed gas discharged during the drying had reached 65%. The hot gas quantity (rotating speed of the blower) was controlled in such a manner that the temperature of the gas outlet port become 30° C.

The shape of the agitating vane of the rotary vane type agitating dryer [manufactured by Fukae Powtec Corporation, DYNAMIC DRYER (trademark) DD-10 Model] is such that the risen portion 15 of each vane piece is removed, and the rake angle of the rake face 18 in the vane piece is set to 45° at the proximal end portion on the side of the rotating drive shaft 2 and 25° at the distal end portion near to the inner wall surface of the agitation vessel so as to have such an inclined structure as become continuously small toward the distal end from the proximal end.

A main axis of each of the gas inlet lines 13 and 13' respectively communicating with the gas inlet ports 6 and 6' was set to an angle of 0° with a tangential direction to the inner peripheral surface of the agitation vessel to blow the heated nitrogen gas into the agitation vessel from each gas inlet port along the direction (the same direction as the tangential direction to the inner peripheral surface of the agitation vessel) of the main axis of the gas inlet line. In this drying step, the water content in the colored resin particles was measured by sampling. As a result, the water content was at most 0.1% by weight after the drying for 45 minutes. The glass transition temperature of the colored resin particles was 52° C.

7. External Additive Addition Step

Within the same rotary vane type agitating dryer [manufactured by Fukae Powtec Corporation, DYNAMIC DRYER (trademark) DD-10 Model] as that used in the drying step, 0.5 parts of fine silica particles (product of Cabot Co., trade name: TG820F) subjected to a hydrophobicity-imparting treatment with cyclosilazane, the number average particle diameter of primary particles of which was 7 nm, and 1.0 part of fine silica particles (product of Nippon Aerosil Co., Ltd., trade name: NA50Y) subjected to a hydrophobicity-imparting treatment with amino-modified silicone oil were added to 100 parts of the colored resin particles just after the drying, and these components were agitated and mixed. The agitation and mixing were conducted for 15 minutes under conditions that the tip speed of the rotary vane was 20 msec, the rotating speed of the chopper blades was 1,000 rpm and the jacket temperature was 15° C. In such a manner, colored resin particles (hereinafter referred to as "toner") with the two kinds of fine silica particles attached to the surfaces thereof as external additives were obtained. The toner is preferably used as a non-magnetic one-component developer. The results are shown in Table 2.

Example 7

A toner was obtained in the same manner as in Example 6 except that in the external additive addition step, the tip speed of the agitating vane was changed to 35 msec from 20 msec. The results are shown in Table 2.

Example 8

A toner was obtained in the same manner as in Example 6 except that in the external additive addition step, the tip speed of the agitating vane was changed to 55 msec from 20 msec, and the treatment time was changed to 10 minutes from 15 minutes. The results are shown in Table 2.

Comparative Example 3

In a drying step, a planetary motion type mixing dryer [manufactured by Shinko Pantec Co., Ltd., trade name: SV MIXER (trademark)] was used in place of the rotary vane type agitating dryer [manufactured by Fukae Powtec Corporation, DYNAMIC DRYER (trademark) DD-10 Model] used in Example 6 to dry wet colored resin particles under conditions shown in Table 2. The colored resin particles are those obtained by the same process as in Example 6.

type agitating dryer [manufactured by Fukae Powtec Corporation, DYNAMIC DRYER (trademark) DD-10 Model] used in Example 6 to dry wet colored resin particles under conditions shown in Table 2. The colored resin particles are those obtained by the same process as in Example 6.

In an external additive addition step subsequent to the drying step, the dry colored resin particles were transferred to a Henschel mixer (manufactured by Mitsui Mining Co., Ltd., trade name: MITSUI HENSCHEL MIXER) to conduct an external additive addition treatment under conditions shown in Table 2. As external additives, were used the same two kinds of fine silica particles as those used in Example 6 in the same amounts. The Henschel mixer is a mixer of the type that strong mixing force is developed by blades (agitating blades) rotating at high speed. The results are shown in Table 2.

TABLE 2

| | Example | | | Comp. Example | |
|---|---|---|---|---|---|
| | 6 | 7 | 8 | 3 | 4 |
| Drying conditions | | | | | |
| Dryer (kind) | A | A | A | B | B |
| Jacket temperature (° C.) | 47 | 47 | 47 | 47 | 47 |
| Gas inlet port temperature (° C.) | 70→50 | 70→50 | 70→50 | — | — |
| Gas outlet port temperature (° C.) | 30 | 30 | 30 | — | — |
| Rotating speed of agitating vane (rpm) | 120 | 120 | 120 | 2 | 2 |
| Tip speed of agitating vane (m/s) | 1.9 | 1.9 | 1.9 | 0.2 | 0.2 |
| Rotating speed of chopper blades (rpm) | 1000 | 1000 | 1000 | — | — |
| Drying time (min) | 45 | 45 | 45 | 120 | 120 |
| Colored resin particles | | | | | |
| Water content (%) | ≤0.1 | ≤0.1 | ≤0.1 | ≤0.1 | ≤0.1 |
| Volume average particle diameter (μm) | 6.5 | 6.5 | 6.5 | 6.5 | 6.5 |
| Particle diameter distribution (dv/dp) | 1.13 | 1.13 | 1.13 | 1.13 | 1.13 |
| External additive addition conditions | | | | | |
| Mixer (kind) | A | A | A | B | C |
| Tip speed of agitating vane (m/s) | 20 | 35 | 55 | 0.2 | 35 |
| Rotating speed of chopper blades (rpm) | 1000 | 1000 | 1000 | — | — |
| Jacket temperature (° C.) | 15 | 15 | 15 | — | 15 |
| Treatment time (min) | 15 | 15 | 10 | 15 | 15 |
| Toner properties | | | | | |
| Initial charge level (μC/g) | 48.9 | 51.2 | 52.3 | 21.6 | 50.5 |
| Fog (%) | 0.9 | 0.7 | 0.5 | — | 0.6 |

(Note)
A: Rotary vane type agitating dryer [manufactured by Fukae Powtec Corporation, DYNAMIC DRYER (trademark) DD-10 Model]
B: Planetary motion type mixing dryer [manufactured by Shinko Pantec Co., Ltd., trade name: SV MIXER (trademark)]
C: Henschel mixer (manufactured by Mitsui Mining Co., Ltd., trade name: MITSUI HENSCHEL MIXER)

Even in an external additive addition step, an external additive addition treatment was conducted under conditions shown in Table 2 within the same planetary motion type mixing dryer (SV MIXER) as that used in the drying step. As external additives, were used the same two kinds of fine silica particles as those used in Example 6 in the same amounts. The SV MIXER used in the drying step and external additive addition step is a device capable of conducting mixing and drying by applying three-dimensional motion to contents within an inverted cone type closed container by a screw vane (agitating vane) revolving on its own axis and orbitally. A jacket is arranged at the SV MIXER, and the temperature can be controlled thereby. The results are shown in Table 2.

Comparative Example 4

In a drying step, a planetary motion type mixing dryer [manufactured by Shinko Pantec Co., Ltd., trade name: SV MIXER (trademark)] was used in place of the rotary vane

[Consideration]

When the planetary motion type mixing dryer (SV MIXER) was used to perform the drying step and external additive addition step (Comparative Example 3), the initial charge level of the resulting toner becomes low in addition to the fact that the drying time becomes long. When the planetary motion type mixing dryer (SV MIXER) was used to conduct the drying step, and the colored resin particles dried were transferred to the Henschel mixer to conduct the external additive addition step (Comparative Example 4), the operation becomes complicated in addition to the fact that the drying time becomes long.

On the other hand, when the rotary vane type agitating dryer (DYNAMIC DRYER) was used to perform the drying step and external additive addition step (Examples 6 to 8), the operation is simple, and toners excellent in toner properties can be obtained in addition to the fact that the drying can be conducted efficiently in a short period of time. According to the process of the present invention, fusion bonding of the colored resin particles to the inner wall surface of the dryer, and fusion bonding among the colored resin particles and deterioration by heat thereof can be prevented. As a result, toners high in initial charge level and excellent in printing durability can be obtained.

INDUSTRIAL APPLICABILITY

The toners obtained by the production process according to the present invention can be used as developers for electrostatic images formed on a photosensitive member in an image forming apparatus of the electrophotographic system (including an electrostatic recording system), such as a copying machine, laser beam printer or facsimile.

The invention claimed is:

1. A production process of a toner composed of colored resin particles, comprising Step 1 of preparing an aqueous dispersion containing colored resin particles formed by a wet process; Step 2 of washing the colored resin particles with water; Filtration Step 3 of separating the colored resin particles by filtration to obtain wet colored resin particles; and Drying Step 4 of drying the wet colored resin particles, wherein in Drying Step 4, (a) the wet colored resin particles are poured into a rotary vane type agitating device having an agitation vessel, a rotating drive shaft and an agitating vane and having a structure that the agitating vane fixed to the rotating drive shaft extending through a bottom wall of the agitation vessel is arranged at a bottom of the agitation vessel, and two gas inlet ports are arranged in opposition to each other at lower portions of the agitation vessel, and at least one gas outlet port is arranged at an upper portion of the agitation vessel, wherein the gas inlet ports are opened on the side upper than the position of the agitating vane and at upper portions of the lower half of the peripheral wall portion of the agitation vessel, and a main axis of a gas inlet line communicating with each of the gas inlet ports is set to an angle within a range from 0 to 30° with a tangential direction to an inner peripheral surface of the agitation vessel, (b) the wet colored resin particles are dried by a method, in which the wet colored resin particles are agitated by the rotary vane within the agitation vessel while supplying a heated gas from the gas inlet ports, thereby forming a fluidized bed of the wet colored resin particles, and a mixed gas containing the heated gas supplied and water volatilized out of the wet colored resin particles is discharged from the gas outlet port to the outside, and (c) the temperature of the heated gas introduced from each of the gas inlet ports is controlled to a temperature within a range from the glass transition temperature of the binder resin component making up the colored resin particles to a temperature higher by 50° C. than the glass transition temperature to start drying, and then at the point of time the relative humidity of the mixed gas discharged from the gas outlet port has reached 40 to 80%, the temperature of the heated gas introduced from each of the gas inlet ports is lowered to a temperature within a range from a temperature lower by 20° C. than the glass transition temperature to the glass transition temperature to continue the drying, and drying conditions are controlled in such a manner that the temperature of the mixed gas discharged from the gas outlet port falls within a range from 20 to 60° C.

2. The production process according to claim 1, wherein in Drying Step 4, the heated gas is supplied from each of the gas inlet ports by a method, in which a main axis of a gas inlet line communicating with each of the gas inlet ports is set to an angle within a range from 3 to 30° with a tangential direction to an inner peripheral surface of the agitation vessel when the heated gas is supplied from each of the gas inlet ports, and the heated gas is blown into the agitation vessel from each of the gas inlet ports along a direction of the main axis of the gas inlet line.

3. The production process according to claim 1, wherein the rotary vane type agitating device has a chopper shaft, on which a plurality of chopper blades has been arranged in its axial direction, wherein the chopper shaft has a structure rotatably pivoted in the inner wall surface of the agitation vessel at both ends thereof and arranged above the agitating vane within the agitation vessel, and wherein in Drying Step 4, the drying is conducted while pulverizing aggregates of the wet colored resin particles by the chopper blades by rotating the chopper shaft.

4. The production process according to claim 1, wherein the rotary vane type agitating device is provided with a jacket outside the agitation vessel at least from the bottom to a side including a portion where the agitating vane is arranged, and in Drying Step 4, the interior of the agitation vessel is heated or thermally insulated by circulating a heated fluid through the jacket.

5. The production process according to claim 1, wherein the heated gas is heated nitrogen gas.

6. The production process according to claim 5, wherein the heated nitrogen gas is introduced into the agitation vessel from each of the gas inlet ports, the nitrogen gas is recovered from the mixed gas discharged from the gas outlet port, and the nitrogen gas recovered is circulated in the agitation vessel as the heated nitrogen gas.

7. The production process according to claim 1, wherein in Drying Step 4, the drying is conducted until the content of water in the colored resin particles is reduced to at most 0.1% by weight.

8. The production process according to claim 1, which further comprises External Additive Addition Step 5 of mixing the dry colored resin particles with an external additive after Drying Step 4, and wherein in External Additive Addition Step 5, the dry colored resin particles are mixed with the external additive in the same rotary vane type agitating device as that used in Drying Step 4.

9. The production process according to claim 8, wherein in External Additive Addition Step 5, the tip speed of the agitating vane is controlled within a range from 10 to 80 m/s.

* * * * *